US012702193B2

(12) United States Patent
Fedderly et al.

(10) Patent No.: US 12,702,193 B2
(45) Date of Patent: Aug. 11, 2026

(54) SOLE STRUCTURES FOR ARTICLES OF FOOTWEAR

(71) Applicant: NIKE, Inc., Beaverton, OR (US)

(72) Inventors: Josh A. Fedderly, Portland, OR (US); Shane S. Kohatsu, Portland, OR (US); Thomas J. Oleson, Beaverton, OR (US); Troy David Schubert, Lake Oswego, OR (US); Darron Trobetsky, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/990,390

(22) Filed: Dec. 20, 2024

(65) Prior Publication Data

US 2025/0204636 A1 Jun. 26, 2025

Related U.S. Application Data

(60) Provisional application No. 63/614,877, filed on Dec. 26, 2023.

(51) Int. Cl.
*A43B 13/18* (2006.01)
*A43B 13/12* (2006.01)
*A43B 13/20* (2006.01)

(52) U.S. Cl.
CPC ..... *A43B 13/183* (2013.01); *A43B 13/127* (2013.01); *A43B 13/20* (2013.01)

(58) Field of Classification Search
CPC ..... A43B 13/183; A43B 13/20; A43B 13/125; A43B 13/127; A43B 13/185
(Continued)

(56) References Cited

U.S. PATENT DOCUMENTS 324,065 A * 8/1885 Andrews ..... A43B 21/32 36/76 R
1,144,188 A * 6/1915 Gerlach ..... A43B 7/06 36/3 R (Continued)

FOREIGN PATENT DOCUMENTS

WO WO 1996/016565 A1 6/1996
WO WO 2009/030017 A1 3/2009
WO WO 2017/042846 A1 3/2017

OTHER PUBLICATIONS

International Search Report and Written Opinion, mailed Mar. 25, 2025, issued for International Patent Application No. PCT/US2024/061354, 13 pages.

*Primary Examiner* — Ted Kavanaugh
(74) *Attorney, Agent, or Firm* — Klarquist Sparkman, LLP

(57) ABSTRACT

A sole structure for an article of footwear can include an outsole, a spring plate, a first midsole member, one or more cushioning elements, and a second midsole member. The spring plate includes an inferior segment and a superior segment. The inferior segment and the superior segment each include an anterior portion and a posterior portion. The inferior segment and the superior segment are piviotably coupled together at their anterior portions. The inferior segment and the superior segment are spaced apart from each other in the anterior/superior direction at their posterior portions. The first midsole member is disposed between the inferior segment of the spring plate and the superior segment of the spring plate. The one or more cushioning elements are disposed between the first midsole portion and the superior segment of the spring plate. The second midsole member is disposed on superior segment of the spring plate.

15 Claims, 23 Drawing Sheets

(58) Field of Classification Search
USPC ..... 36/27, 29
See application file for complete search history.

(56) References Cited

U.S. PATENT DOCUMENTS

| | | | | | |
|---|---|---|---|---|---|
| 1,587,749 | A * | 6/1926 | Bierly | A63C 17/0046 | 280/11.115 |
| 4,492,046 | A * | 1/1985 | Kosova | A43B 13/183 | 36/38 |
| 4,534,124 | A * | 8/1985 | Schnell | A63B 25/10 | 36/114 |
| 5,282,325 | A * | 2/1994 | Beyl | A43B 21/30 | 36/38 |
| 5,353,459 | A * | 10/1994 | Potter | A43B 17/03 | 36/71 |
| 5,353,523 | A * | 10/1994 | Kilgore | A43B 13/20 | 36/35 B |
| 5,435,079 | A * | 7/1995 | Gallegos | A43B 13/184 | 36/38 |
| 6,860,034 | B2 * | 3/2005 | Schmid | A43B 13/181 | 36/35 R |
| 11,096,443 | B2 * | 8/2021 | Connell | A43B 13/141 | |
| 2008/0052965 | A1 * | 3/2008 | Sato | A43B 13/026 | 36/103 |
| 2014/0075779 | A1 * | 3/2014 | Bruce | A43B 13/181 | 36/29 |
| 2023/0380542 | A1 | 11/2023 | Redon et al. | | |

* cited by examiner

SOLE STRUCTURES FOR ARTICLES OF FOOTWEAR

CROSS REFERENCE TO RELATED APPLICATION

This application claims the benefit of U.S. Provisional Application No. 63/614,877, filed Dec. 26, 2023, which is incorporated by reference herein.

FIELD

The present disclosure is directed to articles of footwear, and more particularly to sole structures for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

BRIEF DESCRIPTION

Disclosed herein are articles of footwear that can, for example, enhance a wearer's jumping ability. In particular, the disclosed articles of footwear comprise a sole structure configured to enhance a wearer's jumping ability. The disclosed sole structures comprise a spring plate and/or cushioning elements. The sole structure can also comprise one or more additional components such as one or more midsole members and one or more outsole members.

In some examples, a sole structure for an article of footwear comprises an outsole, a spring plate, a first midsole member, one or more cushioning elements, and a second midsole member. The spring plate comprises an inferior segment and a superior segment. The inferior segment and the superior segment each comprise an anterior portion and a posterior portion. The inferior segment and the superior segment are piviotably coupled together at their anterior portions. The inferior segment and the superior segment are spaced apart from each other in the anterior/superior direction at their posterior portions. The first midsole member is disposed between the inferior segment of the spring plate and the superior segment of the spring plate. The one or more cushioning elements are disposed between the first midsole portion and the superior segment of the spring plate. The second midsole member is disposed on superior segment of the spring plate.

In some examples, a sole structure for an article of footwear comprises a spring plate and a plurality of fluid-filled cushioning elements. The spring plate comprises an inferior segment and a superior segment. The inferior segment and the superior segment each comprise an anterior portion and a posterior portion. The inferior segment and the superior segment are piviotably coupled together at their anterior portions. The inferior segment and the superior segment are spaced apart from each other in the anterior/superior direction at their posterior portions. The plurality of fluid-filled cushioning elements is disposed between the first midsole portion and the superior segment of the spring plate.

In addition to the disclosed sole structures, an article of footwear can comprise an upper, which is coupled to the sole structure.

These and other features, aspects, and/or advantages of the present disclosure will become better understood with reference to the following description and the claims. The accompanying drawings, which are incorporated in and constitute a part of this specification, illustrate examples of the disclosed technology and, together with the description, explain the principles of the disclosure.

DETAILED DESCRIPTION

General Considerations

Figure 1:
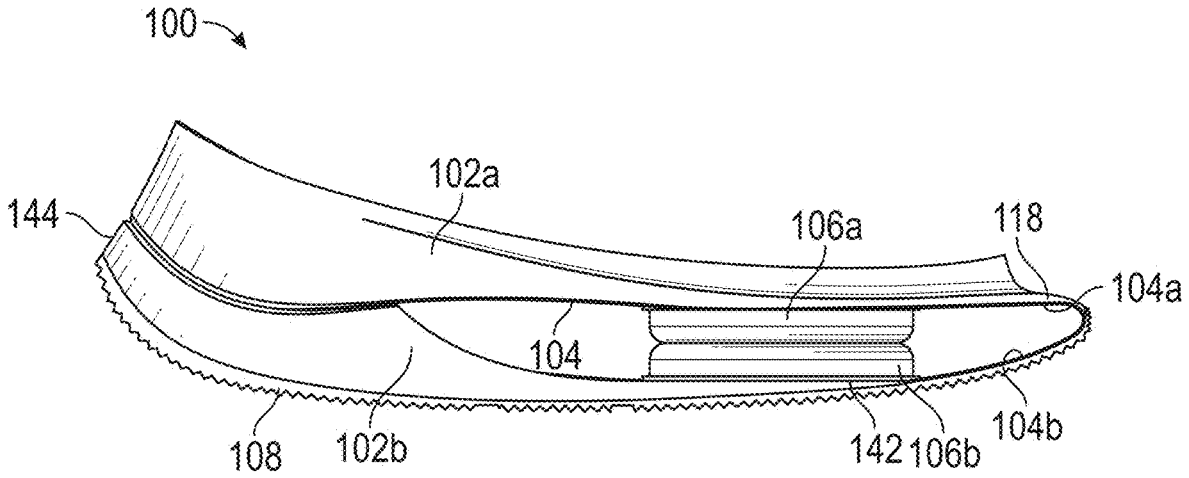
FIG. 1 depicts a lateral side view of a sole structure, according to one example.

The systems and methods described herein, and individual components thereof, should not be construed as being limited to the particular uses or systems described herein in any way. Instead, this disclosure is directed toward all novel and non-obvious features and aspects of the various disclosed examples, alone and in various combinations and subcombinations with one another. For example, any features or aspects of the disclosed examples can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting examples, instances, and/or illustrations.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not depict the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

The articles of footwear and/or the sole structures disclosed herein can be divided into one or more portions (which can also be referred to as "zones," "regions," or "sections"). For example, in an anterior-posterior direction, an article of footwear (and/or its components) can be divided into (and/or include) a forefoot portion, a midfoot portion, and a heel portion. The forefoot portion of the article of footwear can correspond to anterior portions of a foot, including toes and joints connecting metatarsal bones with phalanx bones of the foot. The midfoot portion of the article of footwear can correspond with an arch area of the foot. The heel portion of the article of footwear can correspond with posterior portions of the foot, including a calcaneus bone.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

Examples of the Disclosed Technology

An article of footwear typically includes two main components: a sole structure and an upper. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

In use, a wearer's foot applies various forces to the sole structure and/or the upper. These forces can vary depending on the type of use and/or the physical characteristics (e.g., size, strength) of the wearer.

The sole structure absorbs some of the forces and/or energy exerted upon it as it provides cushioning. In some instances, it is desirable for the sole structure to return as much energy as possible to the wearer to propel them in one or more desired directions, such as upward and/or outward. This can be particularly advantageous for an activity involving running and/or jumping. In some instances, it is desirable for the sole structure to concentrate various forces and/or energy return to one or more specific types of motion (e.g., jumping and/or running forward).

Disclosed herein are examples of articles of footwear and sole structures for articles of footwear that can, for example, return a relatively great portion of the energy to the user and/or concentrate the forces applied to the sole structure to propel the user upward and/or outward. The disclosed sole structures and/or articles of footwear may be useful for various applications. One exemplary application is jumping vertically and/or outwardly such as when dunking a basketball.

The sole structures disclosed herein comprise a spring plate configured to assist a wearer in jumping activities. The spring plate is configured to elastically deform as the wearer compresses the spring plate downward at the beginning phase of a jumping motion. The spring plate is then configured to "spring back" and return to its undeformed shape as the wearer moves to the "takeoff" phase of the jump, thereby urging the wearer upward and outward to greater heights and/or distances than typical articles of footwear.

Additional details and examples are provided below and depicted in the accompanying drawings.

Figure 2:
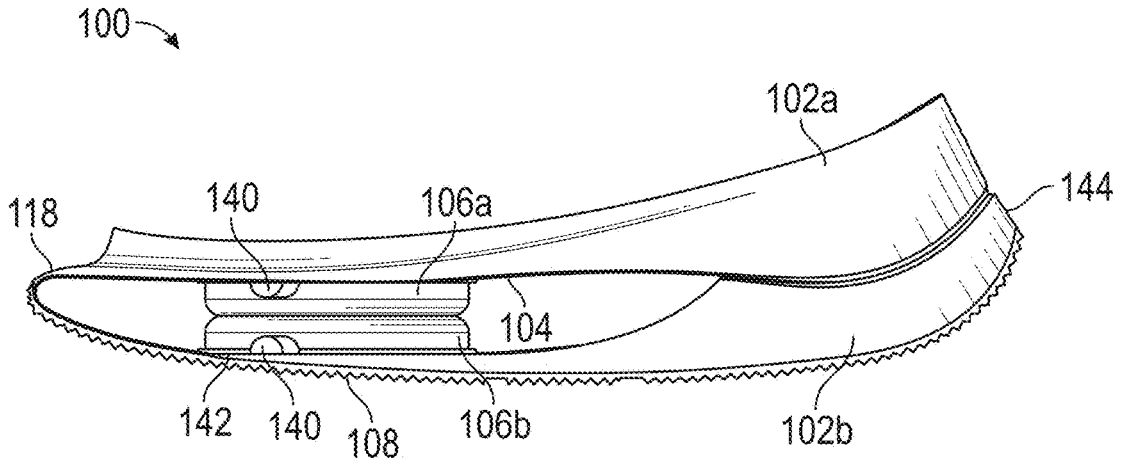
FIG. 2 depicts a medial side view of the sole structure of FIG. 1.
Figure 48:
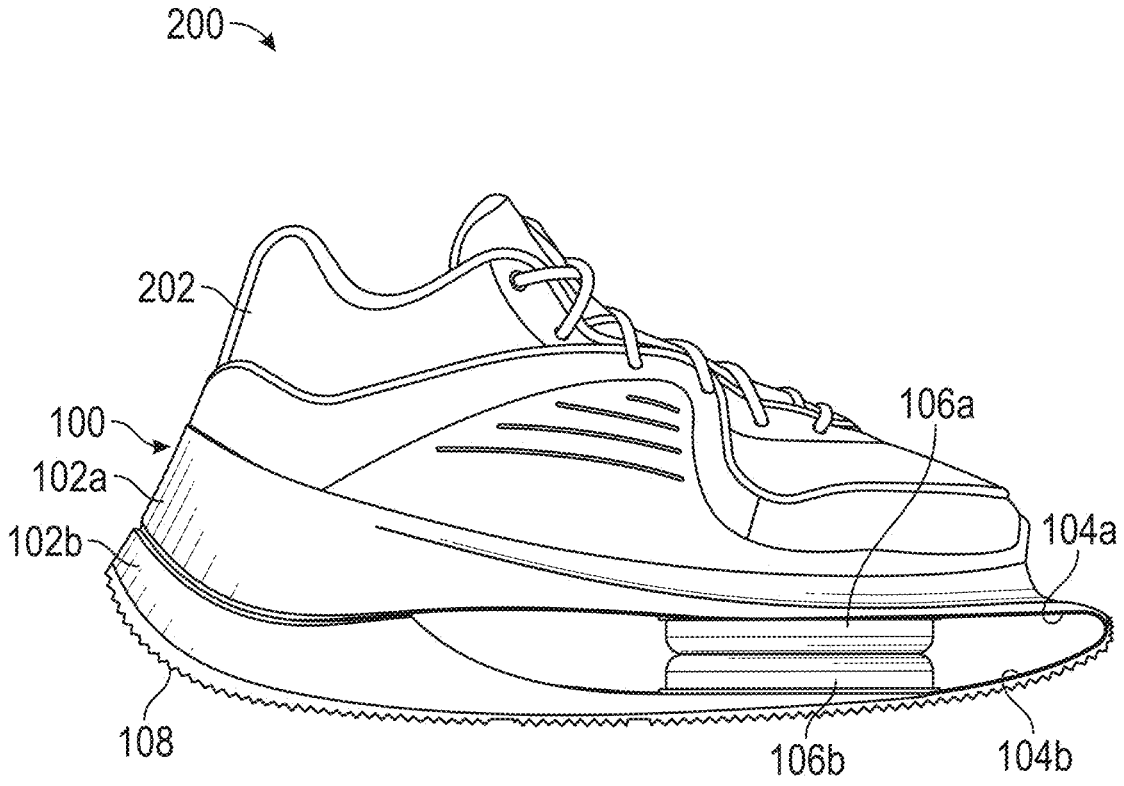
FIG. 48 depicts a lateral side view of an example article of footwear comprising the sole structure of FIG. 1.

FIGS. 1-2 depict a sole structure 100 for an article of footwear, according to one example. The sole structure 100 can also be referred to as "the sole 100." The sole structure 100 and/or any sole structure disclosed herein can be attached to an upper. For example, FIG. 48 depicts the sole structure 100 attached to an upper 202 to form an article of footwear 200.

Returning to FIGS. 1-2, FIG. 1 depicts an elevation view of a lateral side of the sole structure 100 (e.g., configured to be worn on a right foot of a wearer). FIG. 2 depicts an elevation view of a medial side of the sole structure 100.

The sole structures disclosed herein can comprise three main components: a midsole, a spring plate, and an outsole. In some instances, the sole structure can comprise a plurality of midsole members and/or a plurality of outsole members. In some instances, a sole structure can further comprise one or more cushioning elements.

For example, the sole structure 100 comprises a first midsole member 102*a*, a second midsole member 102*b*, a spring plate 104, a first cushioning element 106*a*, and a second cushioning element 106*b*, and an outsole 108. The first midsole member 102*a* and the second midsole member 102*b* can be referred to generically and/or collectively as "the midsole 102" or "the midsole(s) member(s) 102." Similarly, the first cushioning element 106*a* and the second cushioning element 106*b* can be referred to generically and/or collectively as "the cushioning element(s) 106." Other components described herein can follow a similar naming convention when referring to the components generically or collectively.

In the depicted configuration, the first midsole member 102*a* is the superior-most component of the midsole and is configured to be coupled to an upper of an article of footwear. The first midsole member 102*a* is configured to provide cushioning and/or support to the wearer's foot. Additional details of the first midsole member 102*a* are provided below with reference to FIGS. 12-18.

The spring plate 104 is disposed immediately inferior to the first midsole member 102*a*. The spring plate 104 comprises a superior segment 104*a* and an inferior segment 104*b* pivotably coupled together at their anterior portions. The spring plate 104 is configured to elastically deform when compressed (e.g., and wearer loading it) and to resiliently return to its undeformed shape (e.g., when the wearer unloads it). In this manner, the spring plate 104, together with the other components of the sole structure 100, can help propel the wearer upwardly and/or outwardly.

The cushioning elements 106 are disposed between the superior segment 104*a* of the spring plate 104 and the inferior segment 104*b* of the spring plate 104. In some instances, the cushioning elements can comprise one or more of fluid-filled chambers (e.g., airbags). In some examples, the cushioning elements can comprise foam components. In some instances, the foam components can be disposed within a fluid-filled chamber. The cushioning elements 106 can, for example, serve as dampers for the spring plate 104. The cushioning elements can be configured help control the compression and/or rebound rate of the spring plate 104. Additional details of the cushioning elements 106 are provided below with reference to FIGS. 27-33.

The second midsole member 102*b* is disposed between the spring plate 104 and the outsole 108. In particular, a forefoot portion and a midfoot portion of the second midsole member 102*b* are disposed between the inferior segment 104*b* of the spring plate 104 and the outsole 108. The heel portion of the second midsole member 102*b* is disposed between the superior segment 104*a* and the outsole 108. The second midsole member 102*b* is configured, for example, to provide support and/or cushioning to the wearer's foot. Additional details of the second midsole member 102*b* are provided below with reference to FIGS. 34-40.

The outsole 108 is the inferior most component of the sole structure 100 and is configured to contact and provide traction with a surface (e.g., a court, a floor, a track, etc.).

Figure 3:
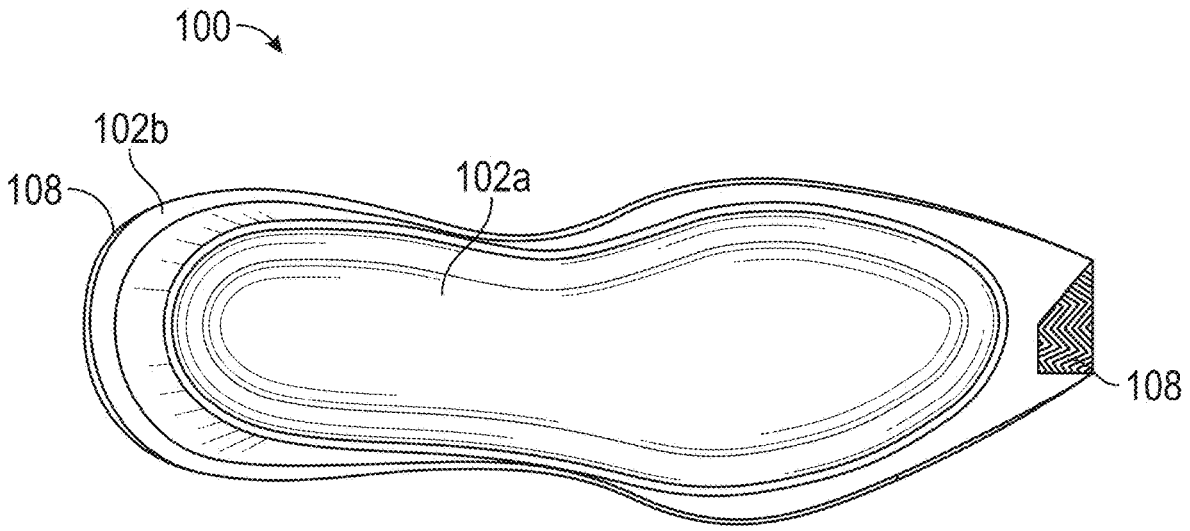
FIG. 3 depicts a superior view of the sole structure of FIG. 1.
Figure 4:
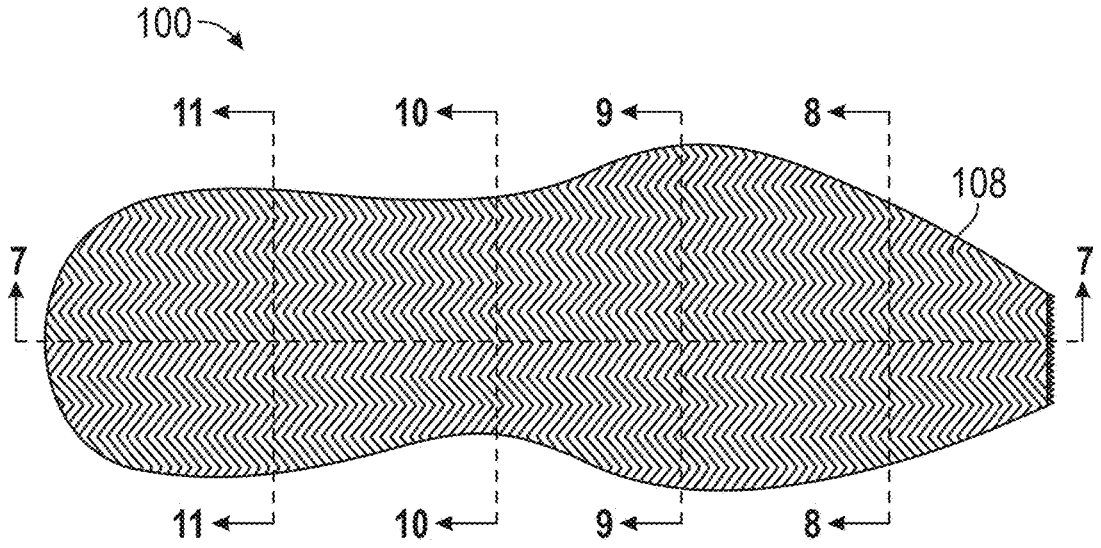
FIG. 4 depicts an inferior view of the sole structure of FIG. 1.

FIG. 3 is a superior view of the sole structure 100 and thus primarily depicts the first midsole member 102*a*. FIG. 3 also depicts some portions of the second midsole member 102*b* and the outsole 108. FIG. 4 is an inferior view of the sole structure 100 and thus depicts the outsole 108.

Figure 5:
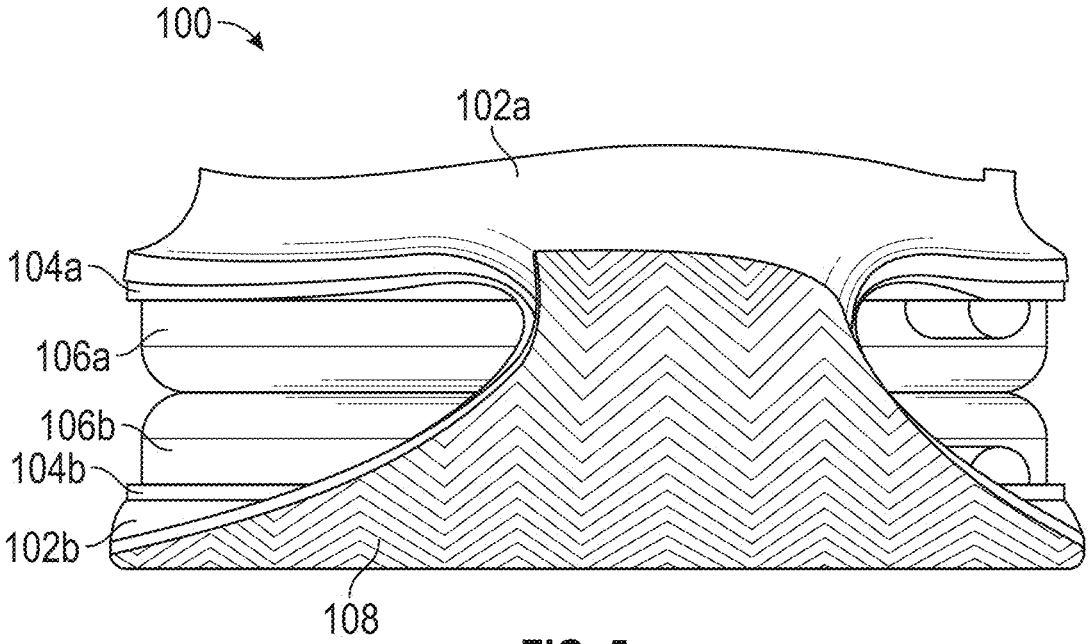
FIG. 5 depicts an anterior end view of the sole structure of FIG. 1.
Figure 6:
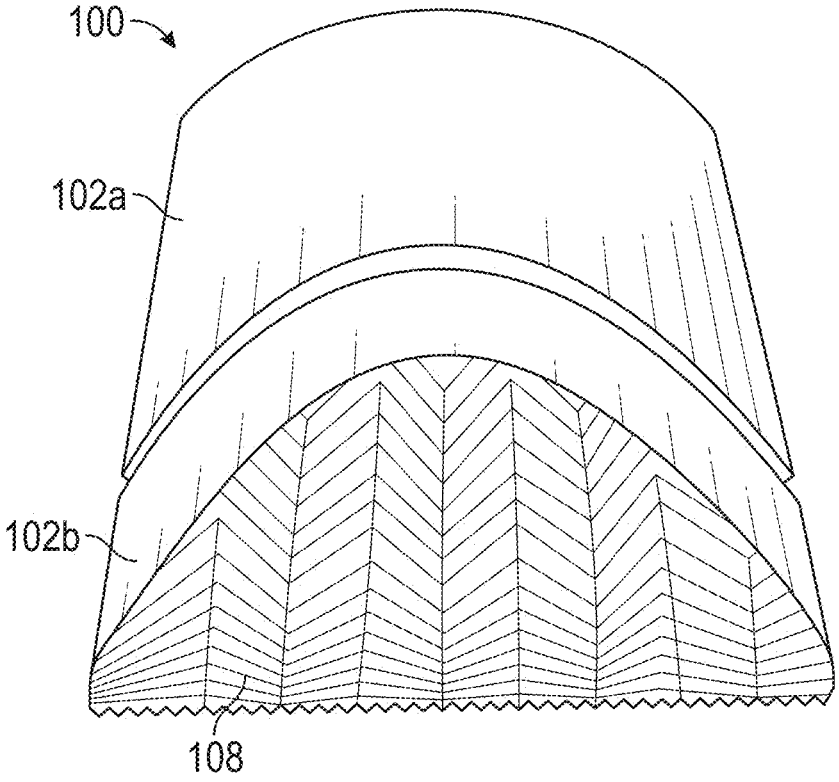
FIG. 6 depicts a posterior end view of the sole structure of FIG. 1.
Figure 7:
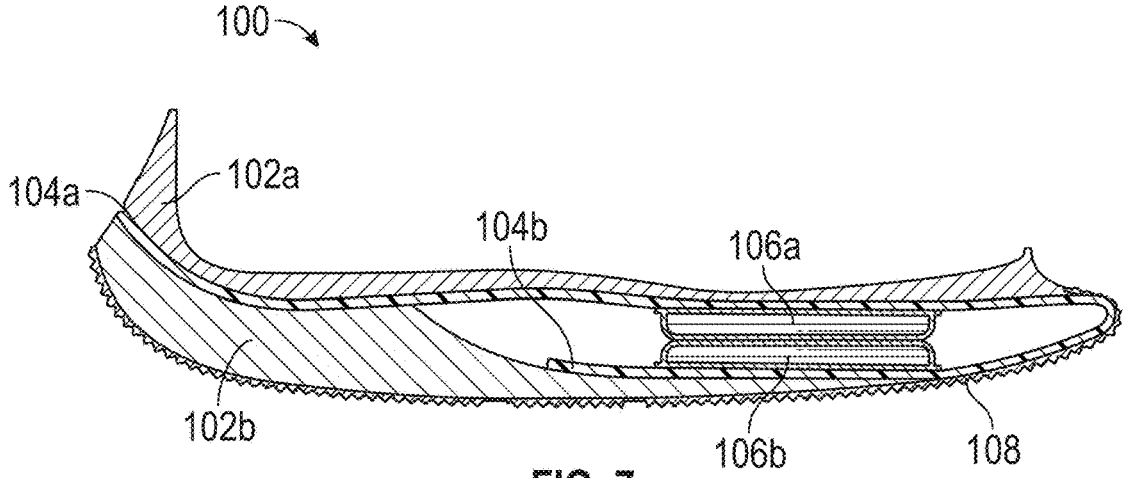
FIG. 7 depicts a cross-sectional view of the sole structure of FIG. 1, taken along the line 7-7 depicted in FIG. 4.
Figure 8:
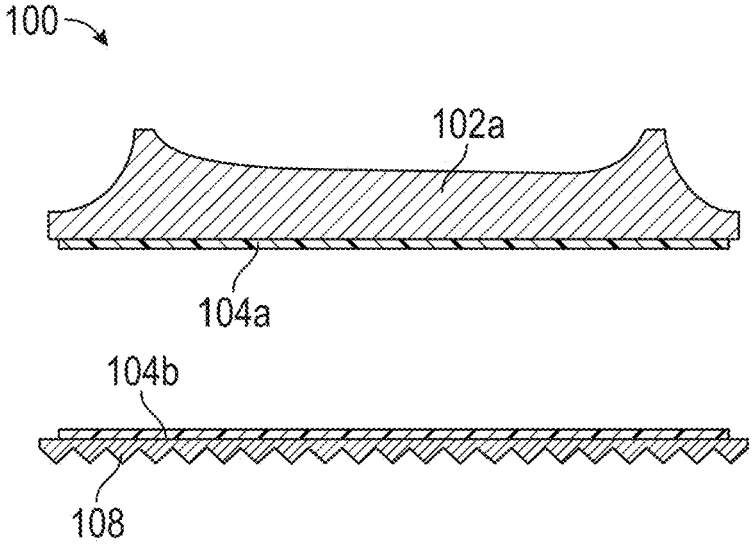
FIG. 8 depicts a cross-sectional view of the sole structure of FIG. 8, taken along the line 8-8 depicted in FIG. 4.
Figure 9:
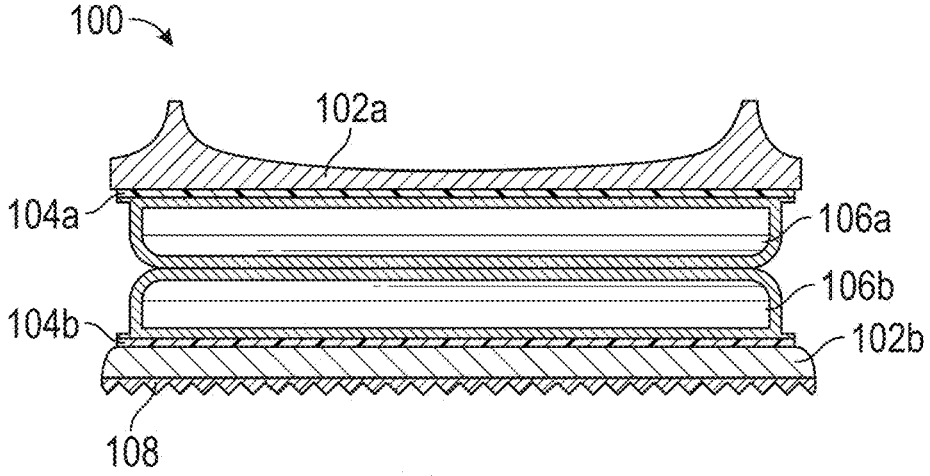
FIG. 9 depicts a cross-sectional view of the sole structure of FIG. 1, taken along the line 9-9 depicted in FIG. 4.
Figure 10:
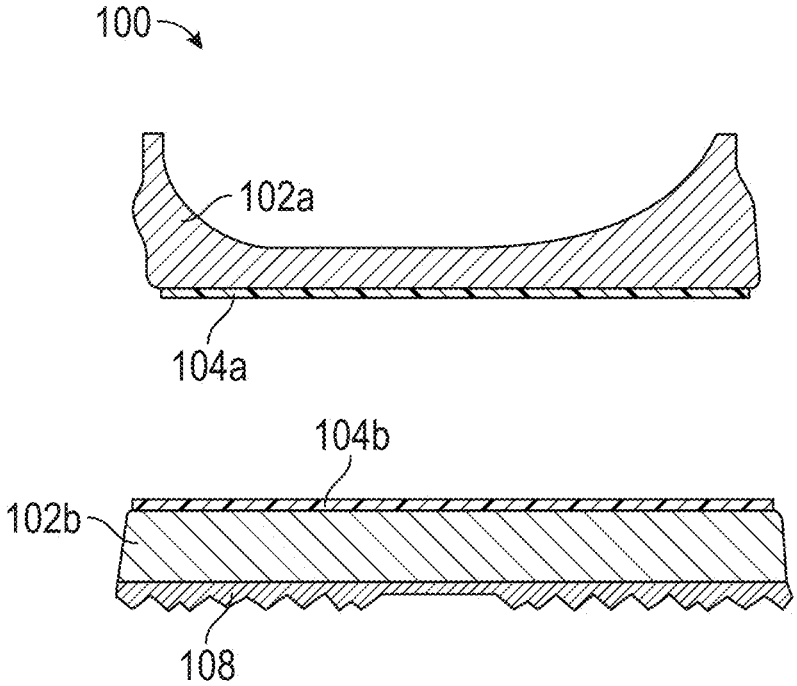
FIG. 10 depicts a cross-sectional view of the sole structure of FIG. 1, taken along the line 10-10 depicted in FIG. 4.
Figure 11:
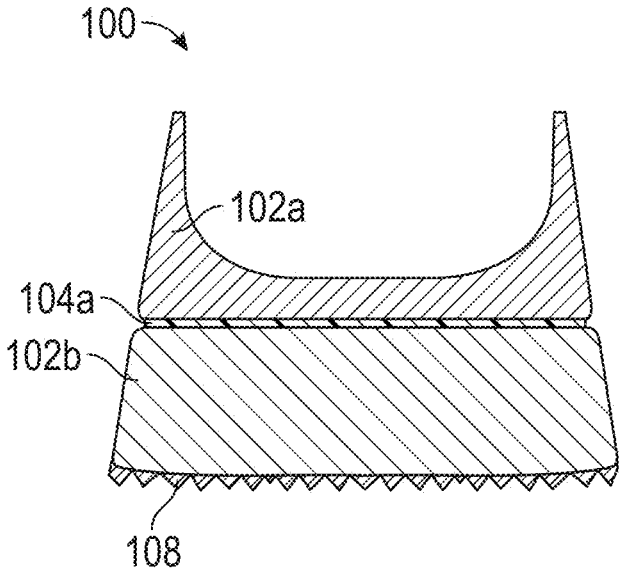
FIG. 11 depicts a cross-sectional view of the sole structure of FIG. 1, taken along the line 11-11 depicted in FIG. 4.

FIG. 5 is an anterior view of the sole structure 100. FIG. 6 is a posterior view of the sole structure 100.

FIGS. 7-11 depict various cross-sectional views, taken from the respective perspectives indicated in FIG. 4. These cross-sectional views, among other things, illustrate the anterior/posterior positioning and relationship of the various components of the sole structure 100.

Referring now to FIGS. 12-18, the first midsole member 102*a* comprises relatively thin forefoot and midfoot portions relative to the heel portion. The superior portion of the first midsole member 102*a* comprises a generally concave footbed 110 defined by a peripheral wall 112. The footbed can be configured to receive the inferior surface of an upper, a strobel, and/or one or more cushioning elements (e.g., airbags, etc.). The peripheral wall 112 can at least partially overlap with an upper of an article of footwear with its edge forming the bite line. In this manner, the peripheral wall 112 can, for example, provide medial/lateral and/or anterior/posterior support to the wearer's foot. As depicted in FIGS. 12-14 and 17, the peripheral wall 112 can be curved. In some examples, the peripheral wall 112 can be relatively high at the posterior region (e.g., compared to the height of the peripheral wall at other regions). In this manner, the peripheral wall 112 can, for example, serve as a heel cup and/or a heel counter (in lieu of or in addition to one or more of heel cup, a heel counter, and/or other heel support members on the upper).

Figure 16:
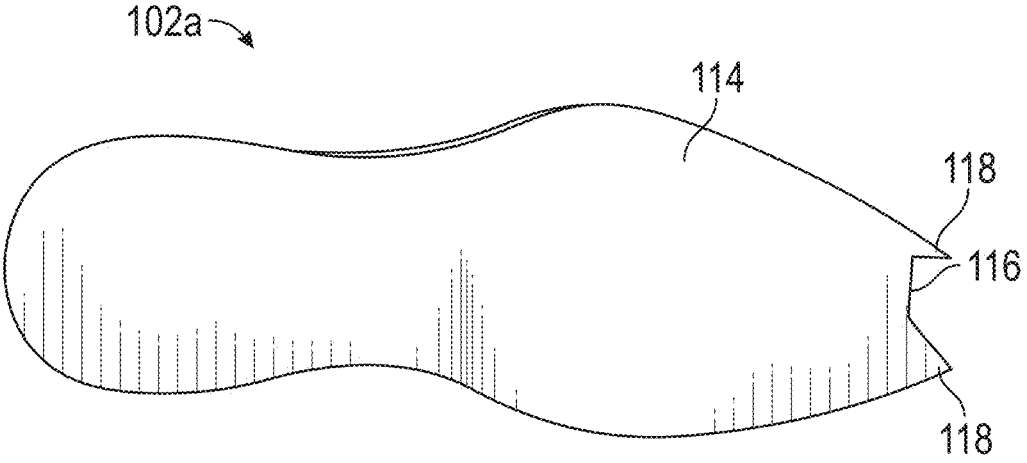
FIG. 16 depicts an inferior view of the first midsole member of the sole structure of FIG. 1.

Referring to FIG. 16, an inferior surface 114 of the first midsole member 102*a* can be configured to be coupled to the spring plate 104. In some examples, the inferior surface 114 can comprise a recess, a lip, tabs, and/or other feature configured to facilitate coupling the first midsole member 102*a* to the spring plate 104. The first midsole member 102*a* can be coupled to the spring plate in various ways, including adhesive, thermal bonding (e.g., ultrasonic welding), fasteners, and/or any other means for coupling.

Figure 12:
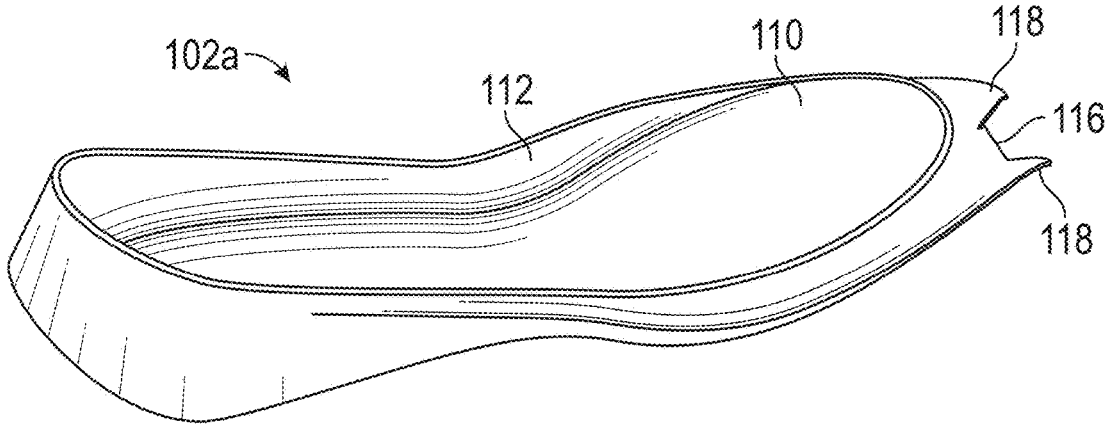
FIG. 12 depicts a perspective view of a first midsole member of the sole structure of FIG. 1.
Figure 15:
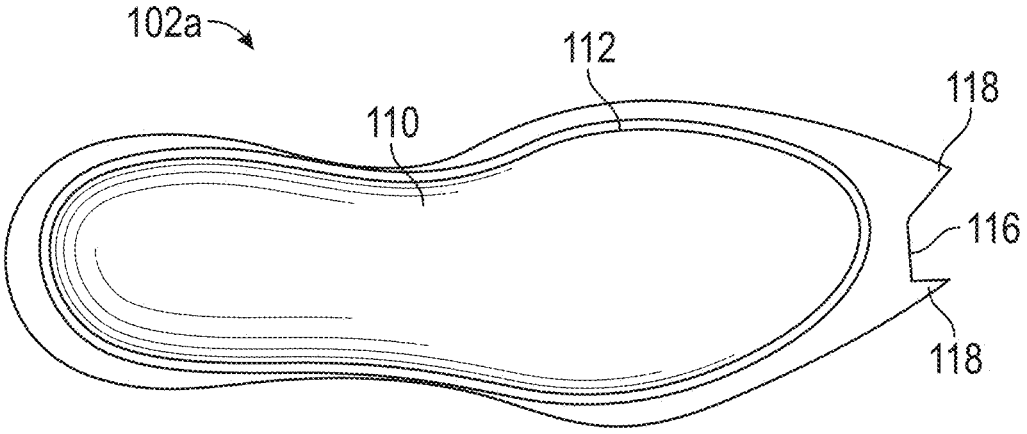
FIG. 15 depicts a superior view of the first midsole member of the sole structure of FIG. 1.
Figure 17:
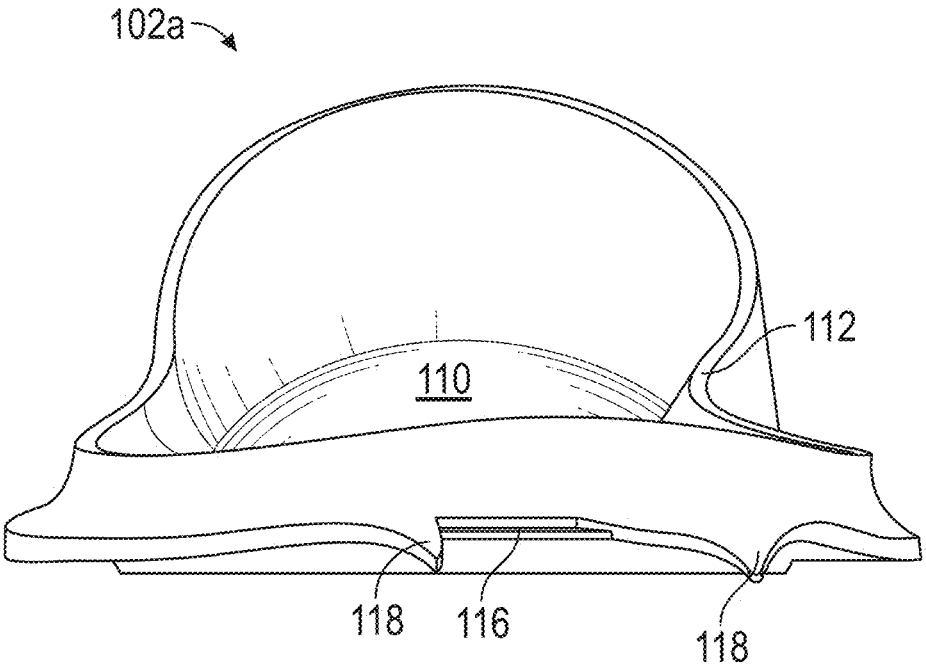
FIG. 17 depicts an anterior end view of the first midsole member of the sole structure of FIG. 1.
Figure 18:
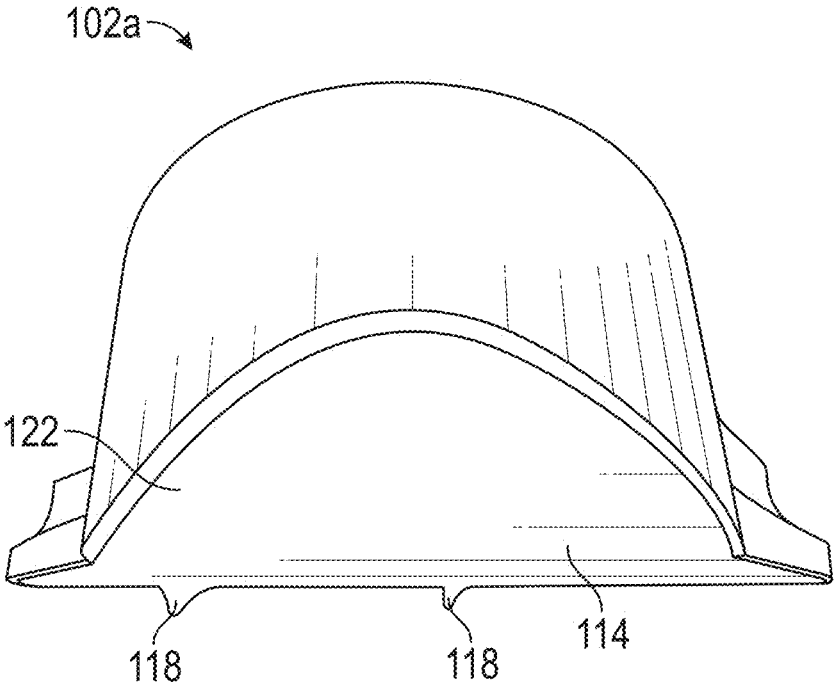
FIG. 18 depicts a posterior end view of the first midsole member of the sole structure of FIG. 1.

Referring to FIGS. 12 and 15, the first midsole member 102*a* can comprise one or more features on the anterior portion configured to receive or accommodate the outsole 108. For example, the first midsole member 102*a* comprises a notch 116 disposed between two projections 118. A toe cap 120 of the outsole 108 can be disposed within the notch 116, as depicted in FIG. 3. In some instances, the projections 118 can be curved and extend in the inferior direction as they also extend in the anterior direction, as depicted in FIGS. 17-18.

Figure 13:
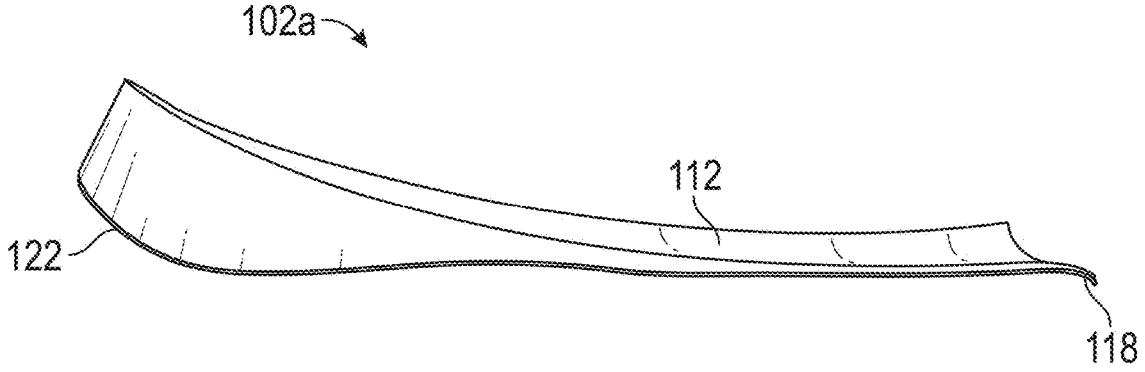
FIG. 13 depicts a lateral side view of the first midsole member of the sole structure of FIG. 1.
Figure 14:
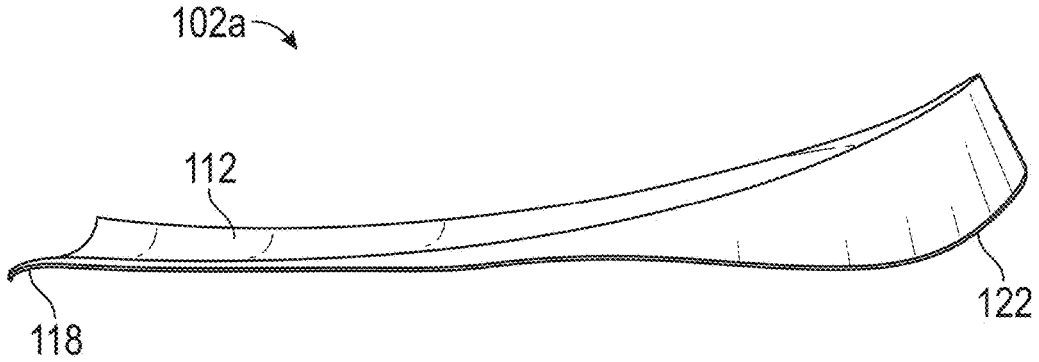
FIG. 14 depicts a medial side view of the first midsole member of the sole structure of FIG. 1.

As depicted in FIGS. 13-14, the posterior portion of the first midsole member 102*a* can comprise a curved heel portion 122.

The first midsole member 102*a* and the second midsole member 102*b* of the sole structure 100 are configured to be positioned under the wearer's foot. The midsoles 102 can be configured to flex and/or elastically deform as the wearer's foot applies pressure upon the sole structure and/or as the sole structure 100 impacts a ground surface. In some examples, the midsole 102 can comprise relatively flexible foam material. In some instances, the first midsole member 102*a* and the second midsole member 102*b* can be formed of the same or substantially similar materials and/or different materials having similar properties (e.g., density, elasticity, hardness, color, etc.). In some examples, the first midsole member 102*a* and the second midsole member 102*b* can be formed different materials and/or the same materials having different properties.

Figure 19:
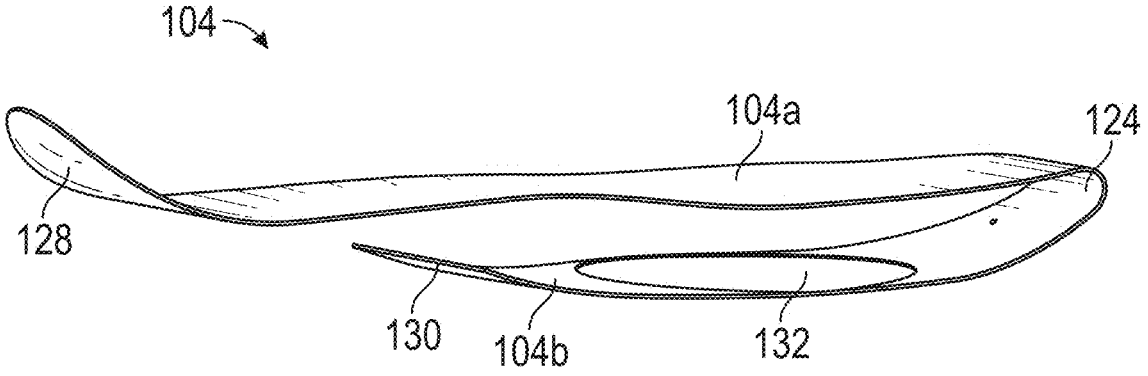
FIG. 19 depicts a perspective view of a spring plate of the sole structure of FIG. 1.
Figure 20:
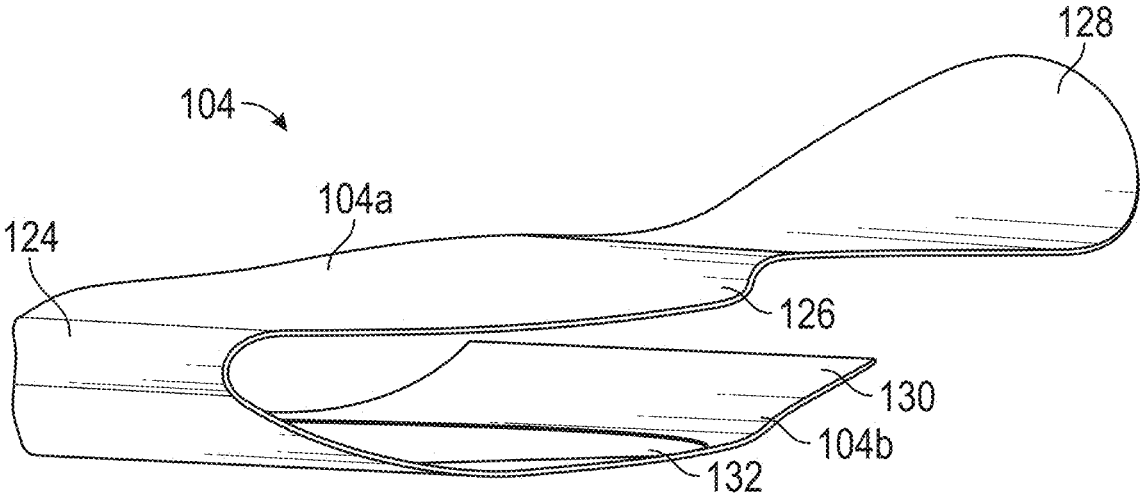
FIG. 20 depicts another perspective view of the spring plate of the sole structure of FIG. 1.
Figure 21:
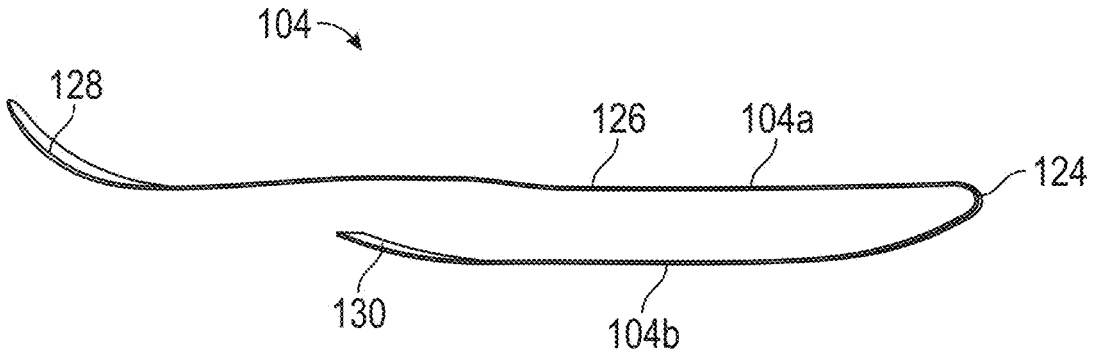
FIG. 21 depicts a lateral side view of the spring plate of the sole structure of FIG. 1.
Figure 22:
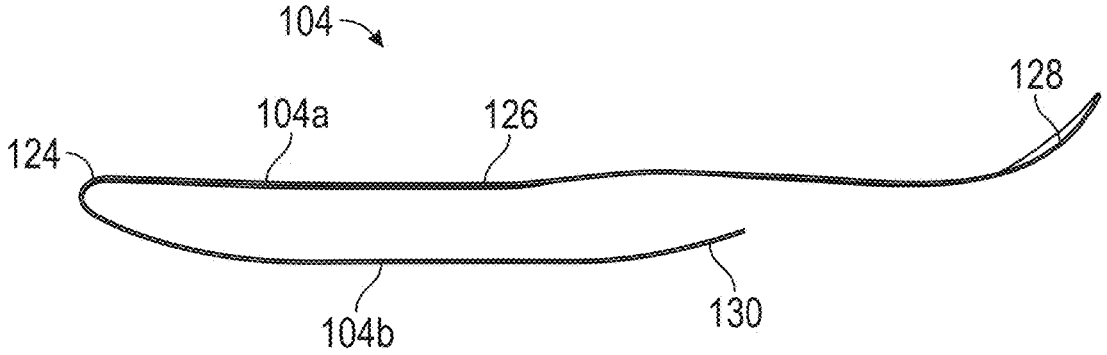
FIG. 22 depicts a medial side view of the spring plate of the sole structure of FIG. 1.
Figure 23:
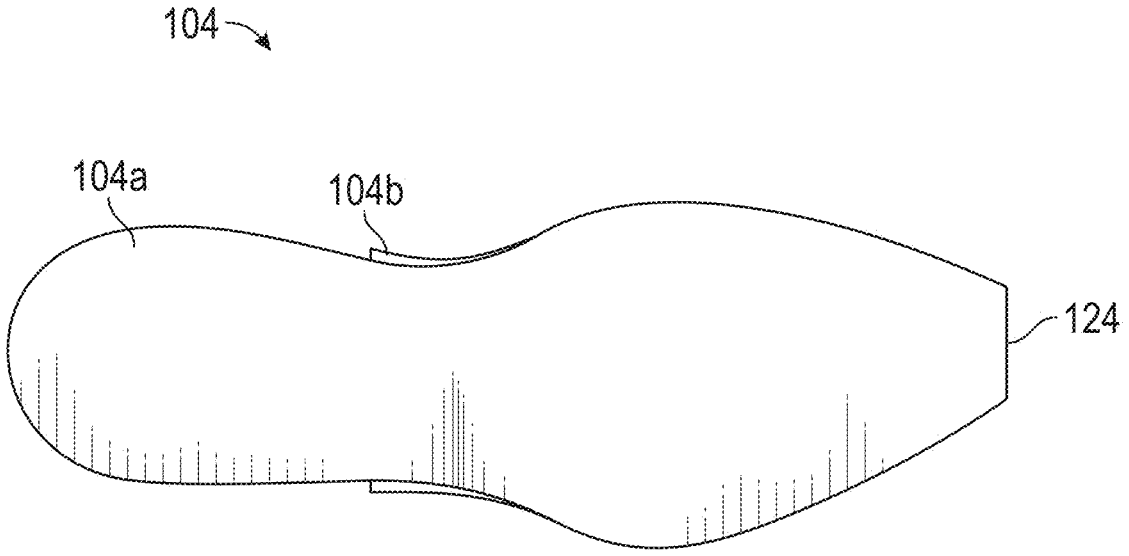
FIG. 23 depicts a superior view of the spring plate of the sole structure of FIG. 1.
Figure 24:
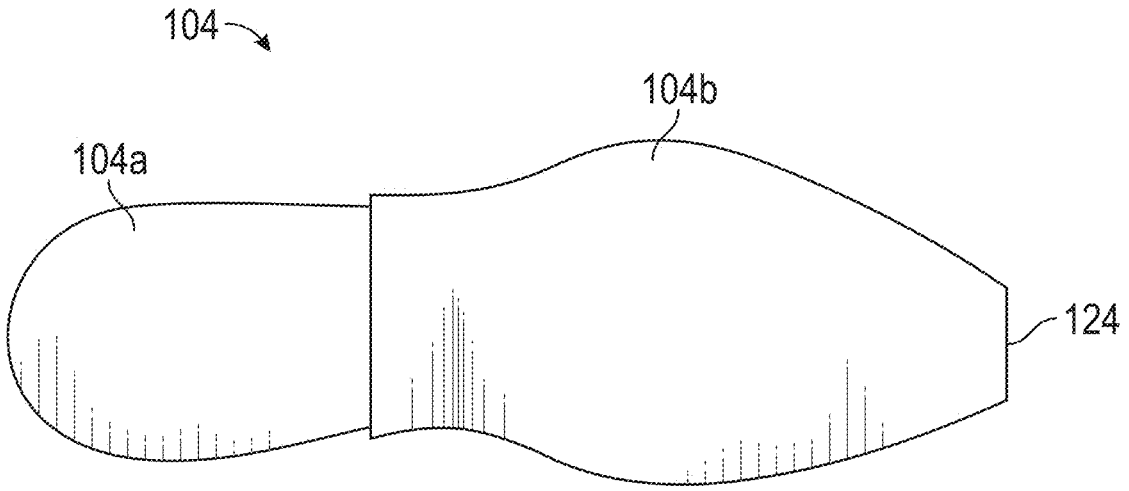
FIG. 24 depicts an inferior view of the spring plate of the sole structure of FIG. 1.
Figure 25:
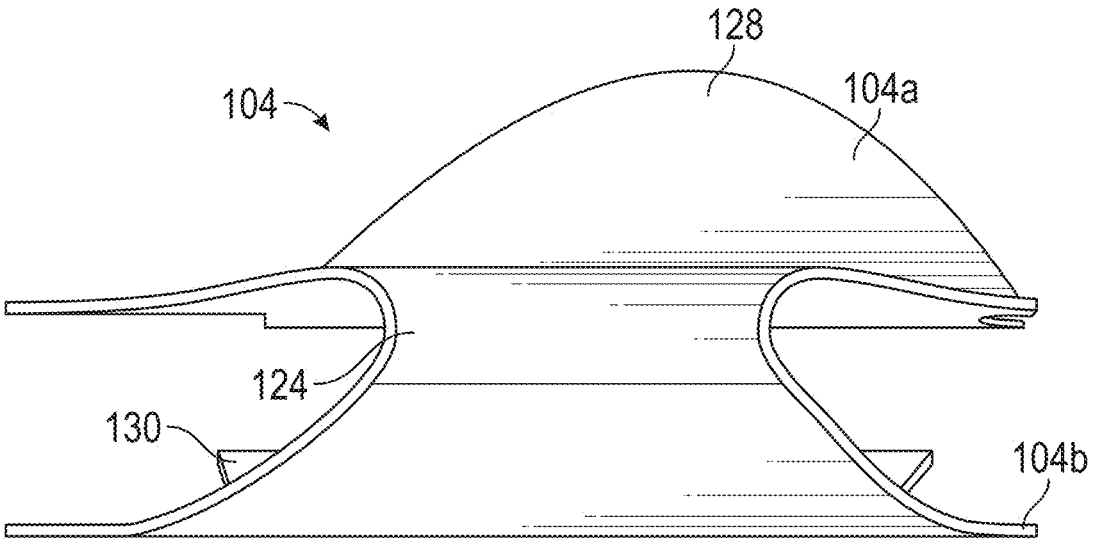
FIG. 25 depicts an anterior end view of the spring plate of the sole structure of FIG. 1.
Figure 26:
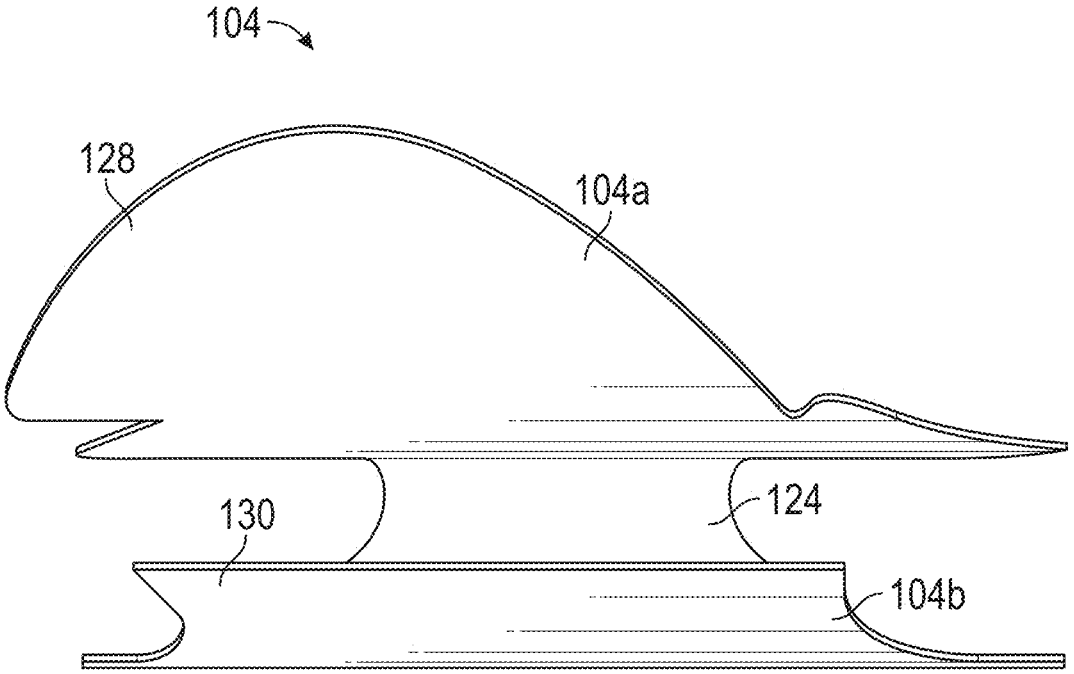
FIG. 26 depicts a posterior end view of the spring plate of the sole structure of FIG. 1.

FIGS. 19-26 depict the spring plate 104. As introduced above, the spring plate 104 comprises the superior segment 104*a* and the inferior segment 104*b*, which meet at the anterior portion 124 but otherwise space apart from each other in the inferior/superior direction. In this manner, the superior segment 104*a* and the inferior segment 104*b* of the spring plate 104 can pivot or deflect relative to each other at the anterior portion 124. As depicted in FIGS. 21-22, in some instances, the superior segment 104*a* of the spring plate 104 extends farther in the posterior direction than the inferior segment 104*b* of the spring plate 104.

In some examples, the superior segment 104*a* and the inferior segment 104*b* can be integrally formed as a single unitary component (e.g., via molding, cutting, etc.). In some instances, the superior segment 104*a* and the inferior segment 104*b* can be formed as separate components that are coupled together (e.g., via fasteners, adhesive, welding, and/or other means for coupling).

The spring plate 104 can be formed from a material that is elastically deformable under the loads that are typically applied thereon by a wearer under typical activities (e.g., walking, running, hopping, jumping, etc.). Some example materials from which the spring plate 104 can be formed include polymers (e.g., thermoplastics such as thermoplastic polyurethane (TPU)), metals (e.g., alloys such as stainless steel and/or nitinol), and/or composites (e.g., carbon fiber, fiberglass, etc.). Due to the elasticity of the spring plate 104, the superior segment 104*a* and the inferior segment 104*b* can be deflected toward each other when loaded and spring back to their biased position when the load is reduced and/or removed.

The superior segment 104*a* of the spring plate 104 can shaped to accommodate one or more other components of the sole structure 100. For example, as depicted in FIGS. 21-22, the superior-facing surface of the superior segment 104*a* can generally follow the inferior-facing surface of the first midsole member 102*a*. In some examples (as shown), the superior segment 104*a* of the spring plate 104 comprises an inclined portion 126 between the forefoot portion and the midfoot portion such that the midfoot and heel portions are disposed superior to the forefoot portion. In some examples (as shown), the superior segment 104*a* of the spring plate 104 comprises a curved heel portion 128. In other instances, the superior segment 104*a* of spring plate 104 can comprise various other shapes. For example, the superior segment 104*a* can be formed without the inclined portion 126 and/or the curved heel portion 128.

Referring still to FIGS. 21-22, the inferior segment 104*b* of the spring plate 104 comprises an inclined portion 130 at the posterior region. In other instances, the inferior segment 104*b* of spring plate 104 can comprise various other shapes. For example, the superior segment 104*a* can be formed without the inclined portion 130.

As depicted in FIGS. 19-20, in some instances, the superior-facing surface of the inferior segment 104*b* comprises a recessed portion 132. The recessed portion 132 is configured to receive the second cushioning element 106*b*. In some examples, a spring plate can comprise a plurality of recessed portions (e.g., corresponding to a plurality of cushioning elements). In some examples, the spring plate can comprise one or more projections (i.e., in lieu of or in addition to one or more recesses), and the projections can be configured to mate with corresponding recesses, opening, and/or other receptacles formed in a cushioning element. The inferior-facing surface of the superior segment 104*a* can also comprise one or more features (e.g., recesses, projections, etc.) configured to receive and/or mate with a cushioning element (e.g., the first cushioning element 106*a*). In some instances, both the superior segment 104*a* and the inferior segment 104*b* comprise the receiving and/or mating features. In some examples, only the superior segment 104*a* comprises the receiving and/or mating features. In some examples, only the inferior segment 104*b* comprises the receiving and/or mating features.

As mentioned above, in some examples, a sole structure can include one or more additional components. For instance, the sole structure 100 comprises a plurality of cushioning elements 106. Various types of cushioning elements can be used. For example, the cushioning elements 106 are fluid-filled capsules (e.g., airbags). As another example, the cushioning elements can be foam pads. As yet another example, the cushioning elements can include a plurality of bead-like members contained within a flexible membrane.

FIGS. 27-33 depict the first cushioning element 106*a*, which is a fluid-filled bladder (e.g., an airbag). In some instances, the first cushioning element 106*a* and the second cushioning element 106*b* are the same or at least substantially similar. For example, the cushioning elements 106 comprise the same shape, dimensions, material, pressure, and/or other characteristics. In some instances, the first cushioning element 106*a* and the second cushioning element 106*b* differ in at least one respect (e.g., pressure, dimensions, etc.). In the depicted example, the first cushioning element 106*a* and the second cushioning element 106*b* are substantially the same structurally, as such only the first cushioning element 106*a* is depicted in FIGS. 27-33. The second cushioning element 106*b* is shown, for example, in FIGS. 1-2.

Figure 27:
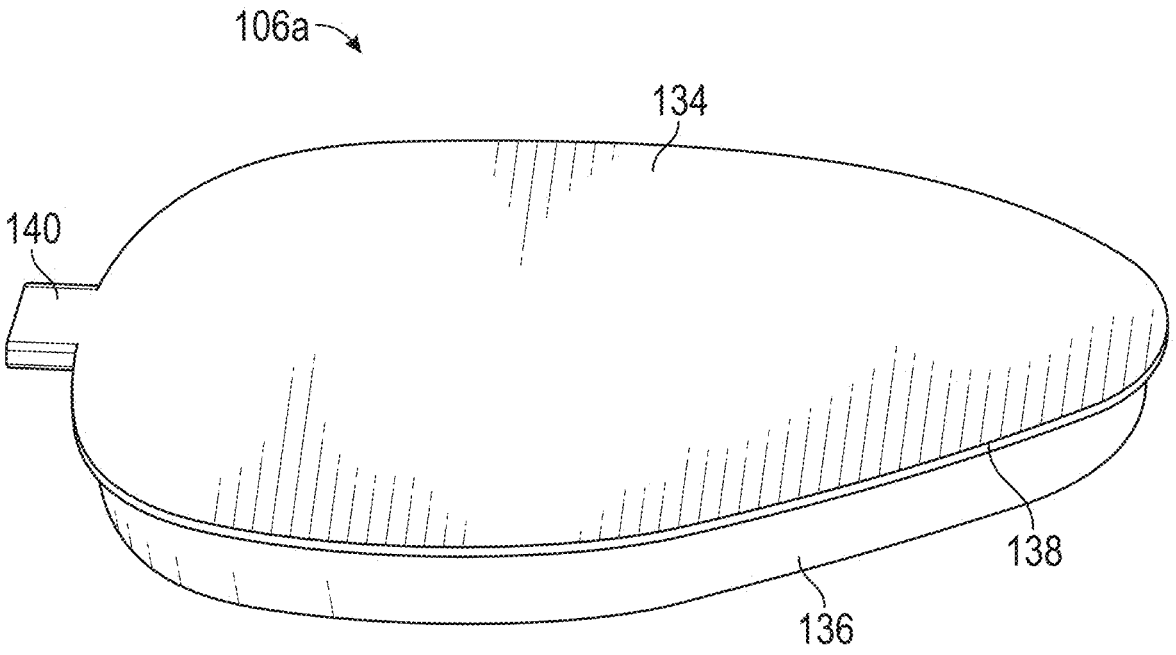
FIG. 27 depicts a perspective view of a first cushioning element of the sole structure of FIG. 1.
Figure 28:
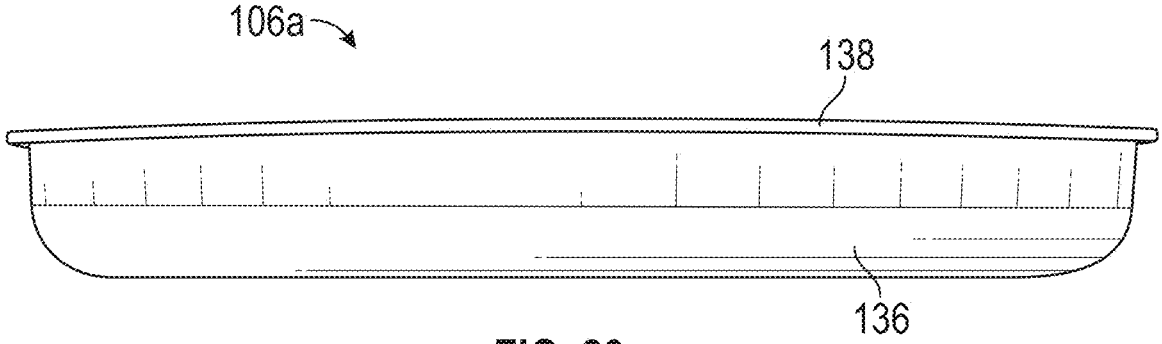
FIG. 28 depicts a lateral side view of the first cushioning element of the sole structure of FIG. 1.
Figure 29:
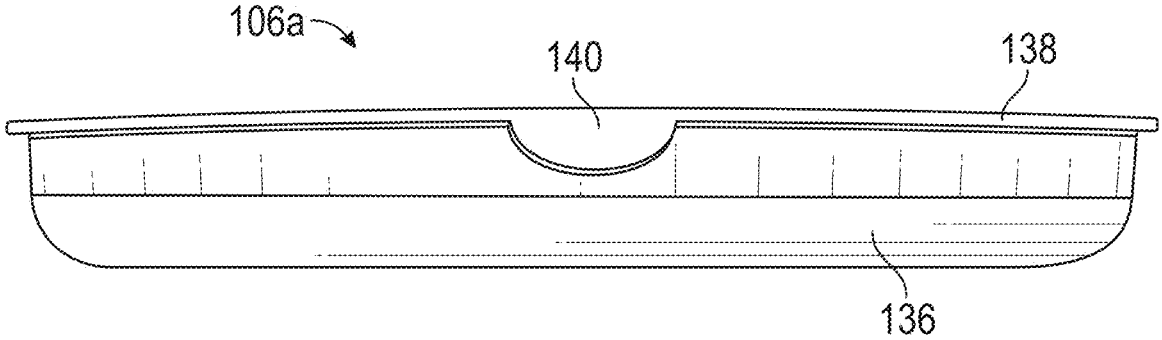
FIG. 29 depicts a medial side view of the first cushioning element of the sole structure of FIG. 1.
Figure 30:
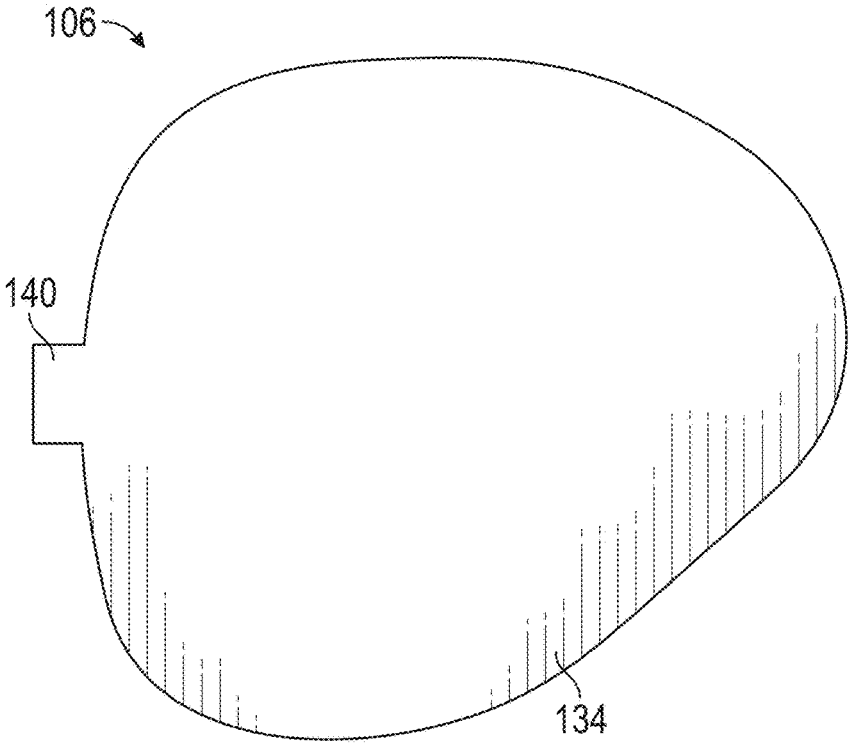
FIG. 30 depicts a superior view of the first cushioning element of the sole structure of FIG. 1.
Figure 31:
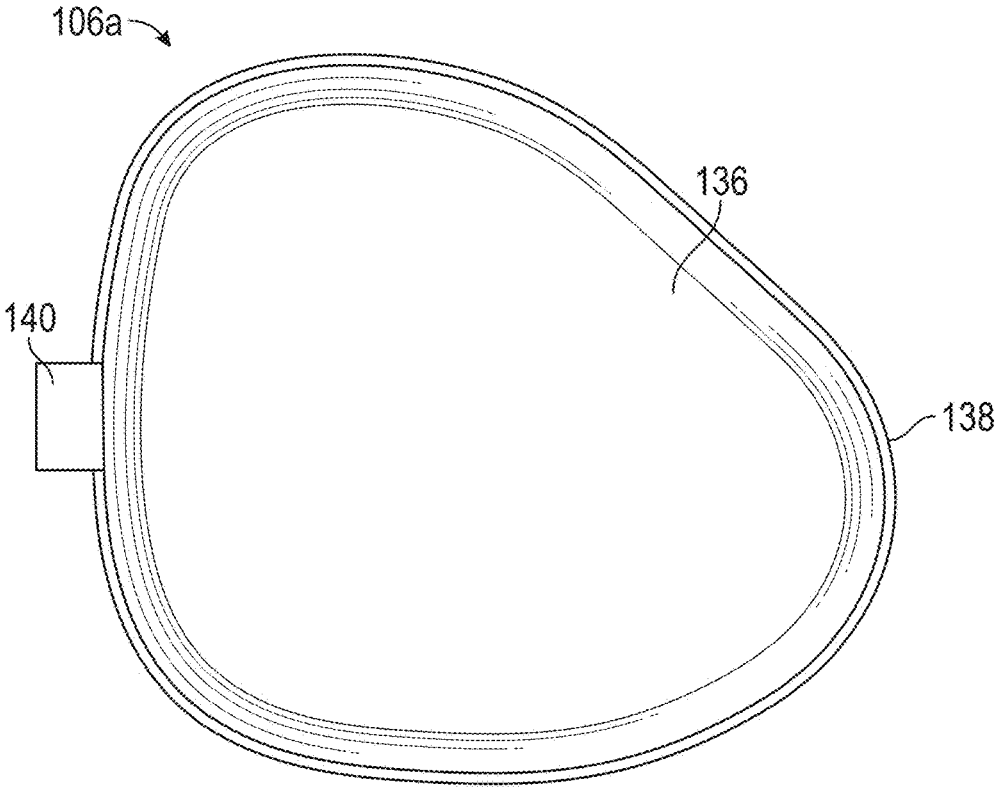
FIG. 31 depicts an inferior view of the first cushioning element of the sole structure of FIG. 1.
Figure 32:
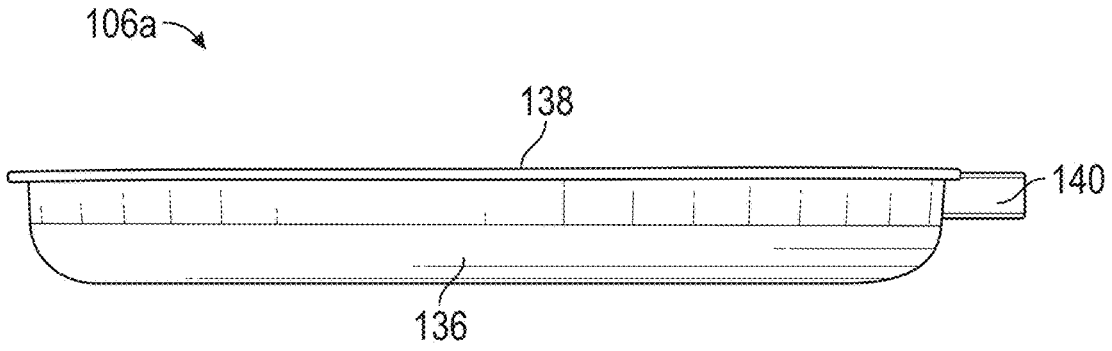
FIG. 32 depicts an anterior end view of the first cushioning element of the sole structure of FIG. 1.
Figure 33:
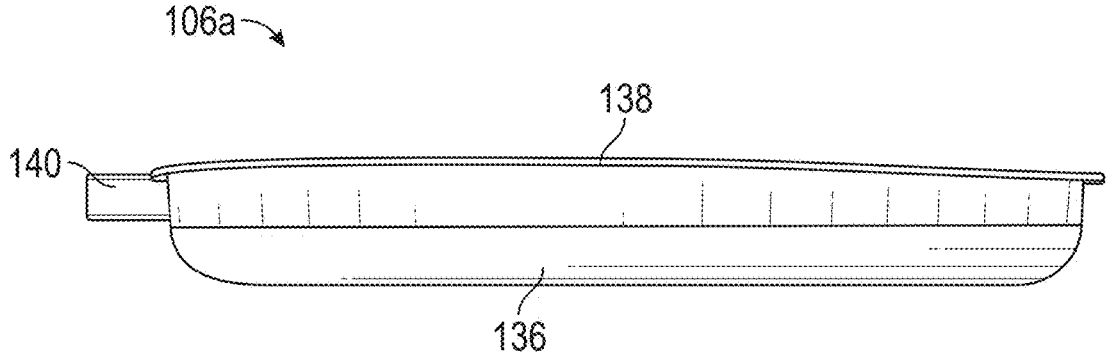
FIG. 33 depicts a posterior end view of the first cushioning element of the sole structure of FIG. 1.

Referring to FIG. 27, the first cushioning element 106*a* includes an opposing pair of barrier layers which can be joined to each other at discrete locations to define a chamber and a peripheral seam 138. In the illustrated embodiment, the barrier layers include a first, superior barrier layer 134 (which can also be referred to as "the upper barrier layer 134") and a second, inferior barrier layer 136 (which can also be referred to as "the lower barrier layer 136"). Alternatively, the chamber can be produced from any suitable combination of one or more barrier layers. The chamber is the space between the barrier layers 134, 136, and the peripheral seam 138 is where the barrier layers are coupled together.

As used herein, the term "barrier layer" (e.g., the barrier layers 134, 136) encompasses both monolayer and multilayer films. In some embodiments, one or both of barrier layers are each produced (e.g., thermoformed or blow molded) from a monolayer film (a single layer). In other embodiments, one or both of barrier layers are each produced (e.g., thermoformed or blow molded) from a multilayer film (multiple sublayers). In either instance, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of barrier layers can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer, and one cannot see clearly through the barrier layer at all. A translucent barrier layer falls between a transparent barrier layer and an opaque barrier layer, and light passes through a translucent layer but some of the light is scattered so that a viewer cannot see clearly through the layer.

Barrier layers can each be produced from an elastomeric material that includes one or more thermoplastic polymers and/or one or more cross-linkable polymers. In some instances, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In some instances, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular instances, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In other instances, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers may include two or more sublayers (multilayer film) such as described in U.S. Pat. Nos. 5,713,141 and 5,952,065, which are incorporated by reference herein. In examples where the barrier layers include two or more sublayers, examples of suitable multilayer films include microlayer films such as those disclosed in U.S. Pat. No. 6,582,786, which is incorporated by reference herein. In further examples, the barrier layers may each independently include alternating sublayers of one or more TPU copolymer materials and one or more EVOH copolymer materials, where the total number of sublayers in each of barrier layers includes at least four sublayers, at least ten sublayers, at least twenty sublayers, at least forty sublayers, and/or at least sixty sublayers.

The chamber can be produced from barrier layers using any suitable technique, such as thermoforming (e.g., vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In some examples, the barrier layers can be produced by co-extrusion followed by vacuum thermoforming to produce the chamber, which can optionally include one or more valves (e.g., one-way valves) that allows the chamber to be filled with the fluid (e.g., gas).

The chamber can be provided in a fluid-filled or in an unfilled state. The chamber can be filled to include any suitable fluid, such as a gas or liquid. In an aspect, the gas can include air, nitrogen ($N_2$), or any other suitable gas. In other instances, the chamber can alternatively include other media, such as pellets, beads, ground recycled material, and the like (e.g., foamed beads and/or rubber beads). The fluid provided to the chamber can result in the chamber being pressurized (i.e., comprises a pressure greater than atmospheric pressure). The pressure (and/or other characteristic of the cushioning elements 106) can be selected help control the compression and/or rebound between the superior segment 104*a* of the spring plate 104 and the inferior segment of the spring plate 104. In some examples, the fluid provided to the chamber can be at atmospheric pressure such that the chamber is not pressurized but, rather, contains a volume of fluid at atmospheric pressure.

The chamber desirably has a low gas transmission rate to preserve its retained gas pressure. In some examples, the chamber has a gas transmission rate for nitrogen gas that is at least about ten times lower than a nitrogen gas transmission rate for a butyl rubber layer of substantially the same dimensions. In particular instances, the chamber 26 has a nitrogen gas transmission rate of 15 cubic-centimeter/square-meter·atmosphere-day ($cm^3/m^2 \cdot atm \cdot day$) or less for an average film thickness of 500 micrometers (based on thicknesses of barrier layers). In further instances, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some implementations, the upper barrier layer and the lower barrier layer cooperate to define a geometry (e.g., thicknesses, width, and lengths) of the chamber. For example, the peripheral seam 138 may cooperate to bound and extend around the chamber to seal the fluid (e.g., air) within the chamber. Thus, the chamber is associated with an area where interior surfaces of the upper and lower barrier layers are separated from one another.

The space formed between opposing interior surfaces of the upper and lower barrier layers defines an interior void of the chamber. Similarly, the exterior surfaces of the upper and lower barrier layers define an exterior profile of the first cushioning element 106*a*. Accordingly, the upper and lower barrier layers define respective upper and lower surfaces of the bladder.

The first cushioning element 106*a* can comprise a port 140. The port 140 can be used, for example, to fill the chamber of the first cushioning element 106*a*. As depicted, the port 140 can be disposed on the medial side of the first cushioning element 106*a*. In some instances, the port can be disposed at another location of the first cushioning element, such as the anterior, posterior, or lateral side.

In some examples, the superior-facing surface of the first barrier layer 134 of the first cushioning element 106*a* can be configured to be received within a recess that is formed in the inferior-facing surface of the superior segment 104*a* of the spring plate 104. Similarly, the inferior-facing surface of the second cushioning element 106*b* can be configured to be received within the recessed portion 132 of the inferior segment 104*b* of the spring plate 104.

Referring to FIG. 1, the first cushioning element 106*a* and the second cushioning element 106*b* are stacked directly on one another. In particular implementations, the sole structure can include one or more additional components (e.g., one or more additional cushioning elements and/or one or more components between the cushioning elements) and/or omit one or more of the components of the sole structure (e.g., there may only one cushioning element, or there may be no cushioning elements). Additional cushioning element configurations are provided below with reference to FIGS. 49-51.

FIGS. 34-40 depict the second midsole member 102*b*. As depicted in FIG. 1, the second midsole member 102*b* is disposed between the spring plate 104 and the outsole 108. More particularly, a forefoot and midfoot portions of the second midsole member 102*b* are disposed between the inferior segment 104*b* of the spring plate 104 and the outsole 108, and a heel portion of the second midsole member 102*b* is disposed between the superior segment 104*a* of the spring plate 104 and the outsole 108.

Referring still to FIG. 1, an anterior end 142 of the second midsole member 102*b* is aligned (at least substantially) with anterior-most edge of the second cushioning element 106*b*. See also FIGS. 8-9. In some instances, the second midsole member 102*b* can extend farther in the anterior direction than the depicted example (e.g., beyond the cushioning elements 106). In some instances, the second midsole member 102*b* can terminate under or posterior to the cushioning elements 106. A posterior end 144 of the second midsole member 102*b* can define (at least in part) a posterior end of the sole structure 100.

Figure 34:
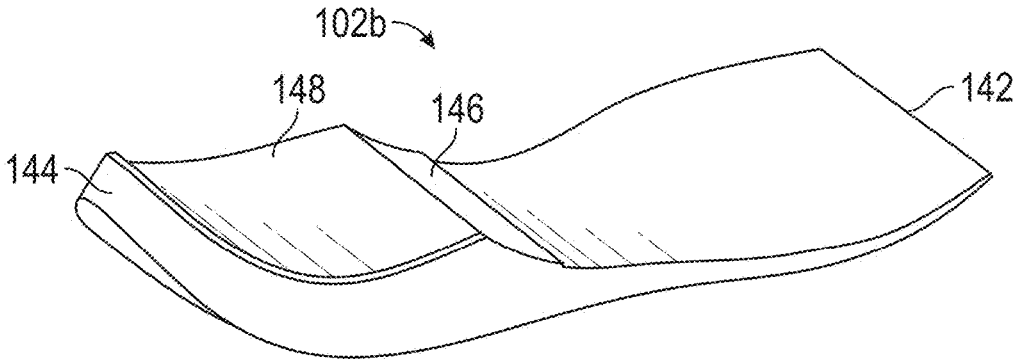
FIG. 34 depicts a perspective view of a second midsole member of the sole structure of FIG. 1.
Figure 35:
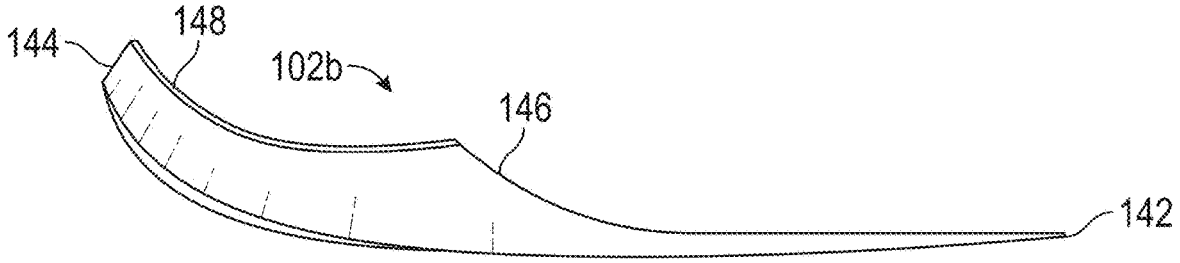
FIG. 35 depicts a lateral side view of the second midsole member of the sole structure of FIG. 1.
Figure 36:
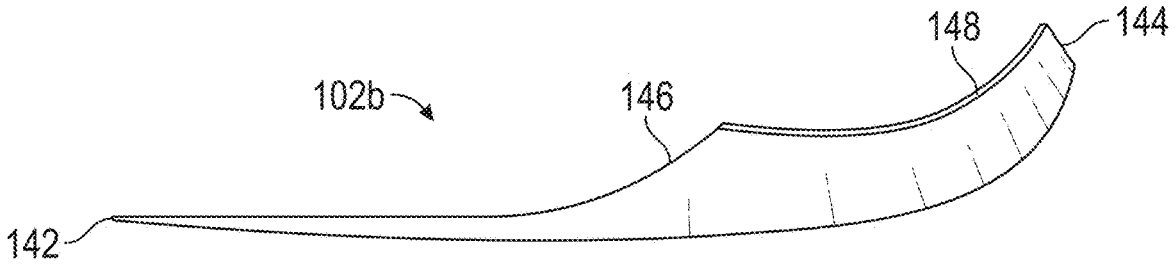
FIG. 36 depicts a medial side view of the second midsole member of the sole structure of FIG. 1.
Figure 37:
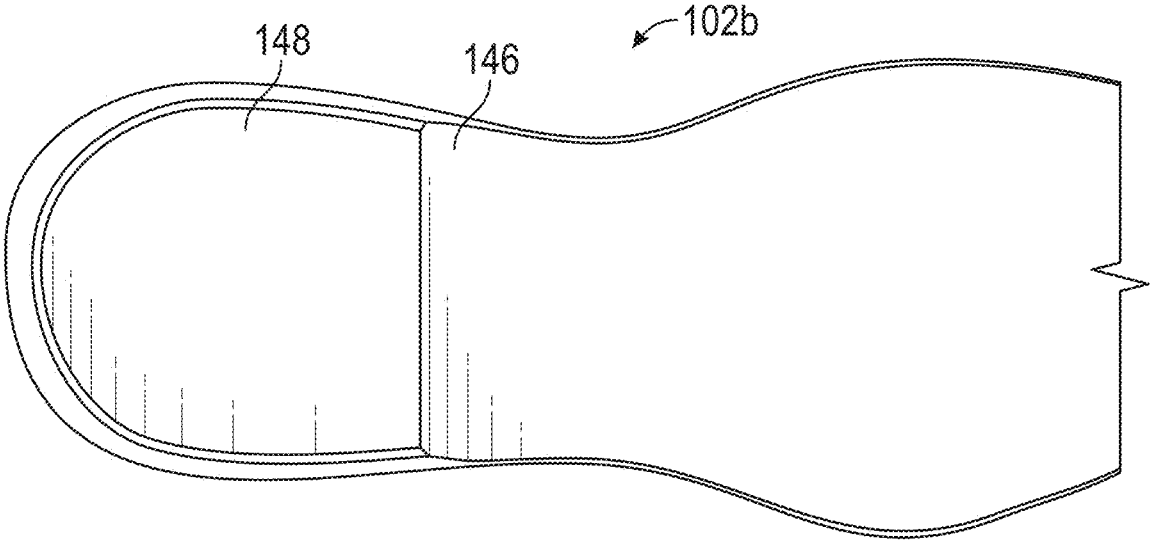
FIG. 37 depicts a superior view of the second midsole member of the sole structure of FIG. 1.
Figure 38:
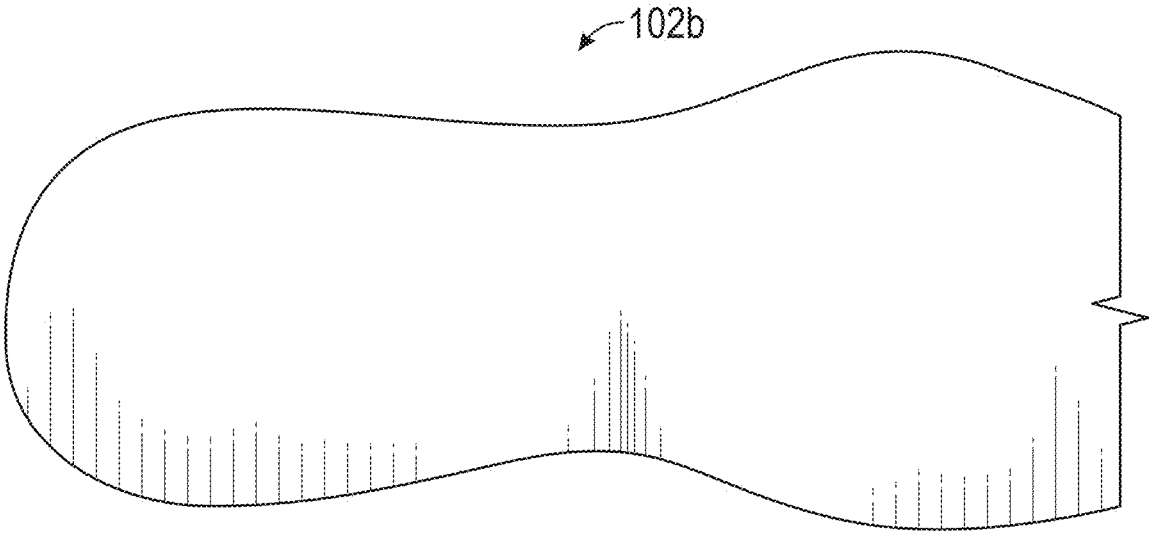
FIG. 38 depicts an inferior view of the second midsole member of the sole structure of FIG. 1.
Figure 39:
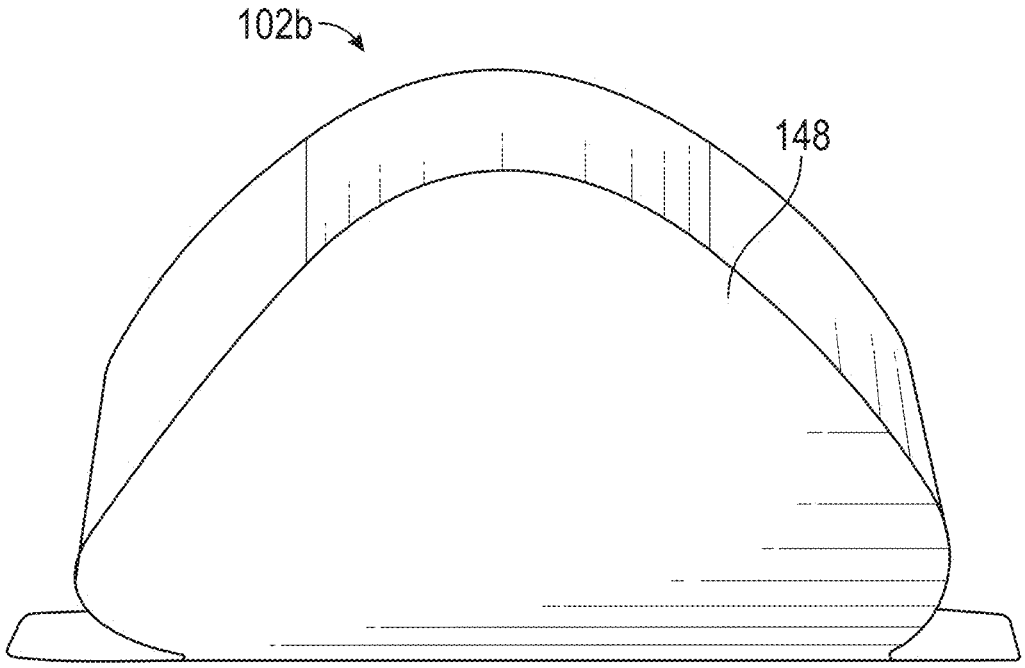
FIG. 39 depicts an anterior end view of the second midsole member of the sole structure of FIG. 1.
Figure 40:
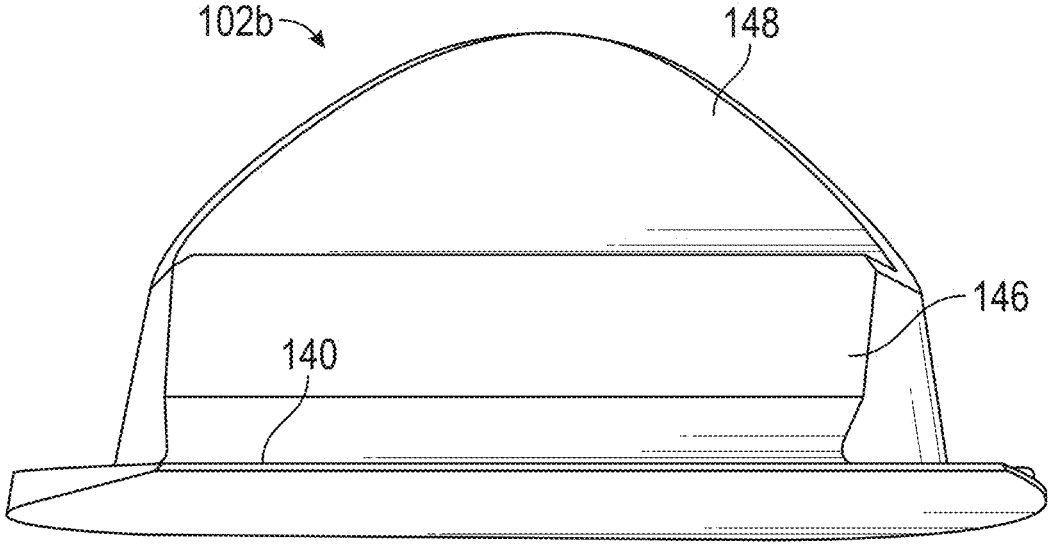
FIG. 40 depicts a posterior end view of the second midsole member of the sole structure of FIG. 1.
Figure 41:
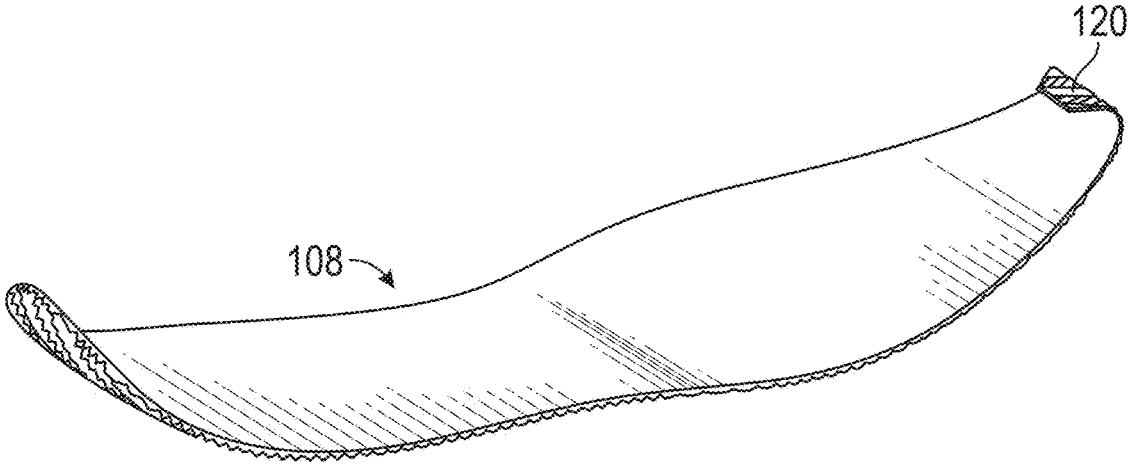
FIG. 41 depicts a perspective view of an outsole of the sole structure of FIG. 1.
Figure 42:
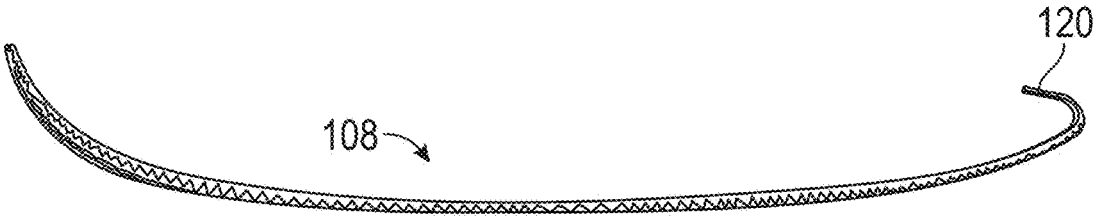
FIG. 42 depicts a lateral side view of the outsole of the sole structure of FIG. 1.
Figure 43:
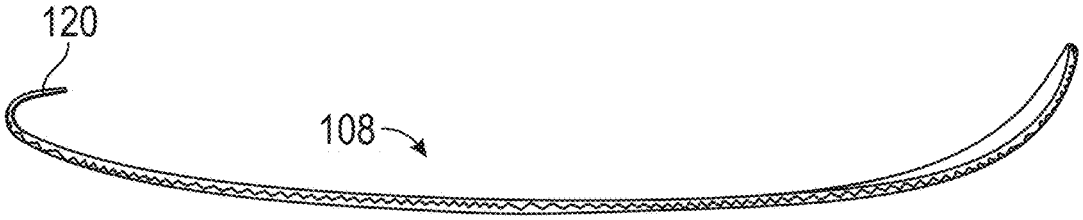
FIG. 43 depicts a medial side view of the outsole of the sole structure of FIG. 1.
Figure 44:
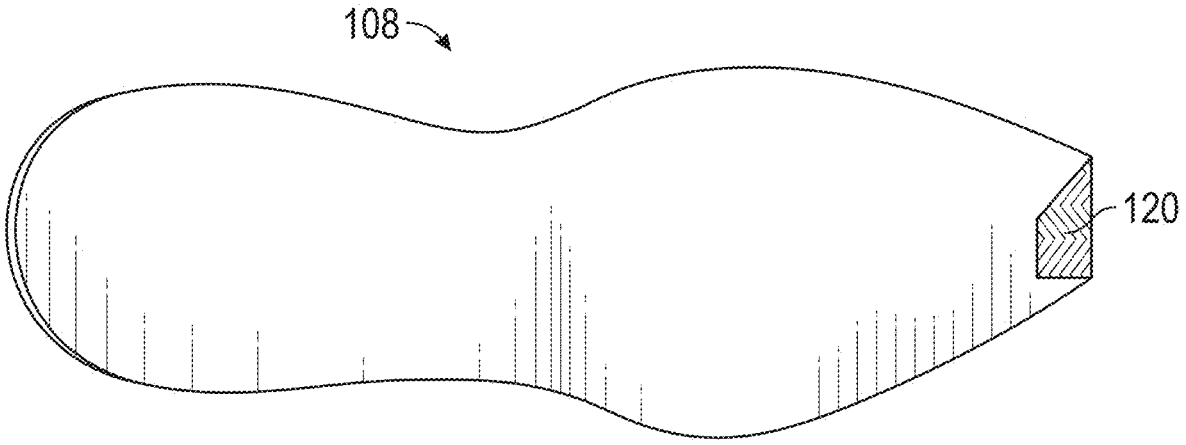
FIG. 44 depicts a superior view of the outsole of the sole structure of FIG. 1.

Referring to FIGS. 34-36, the second midsole member 102*b* can have a relatively low height (which can also be referred to as "thickness") at the anterior end portion and can taper (at least generally) to a greater height at the posterior end portion. The second midsole member 102*b* comprises an inclined portion 146 proximate the posterior end of the midfoot portion. The second midsole member 102*b* also comprises a curved heel portion 148 that corresponds to the curved heel portions 122, 128 of the first midsole member 102*a* and the spring plate 104, respectively.

Figure 45:
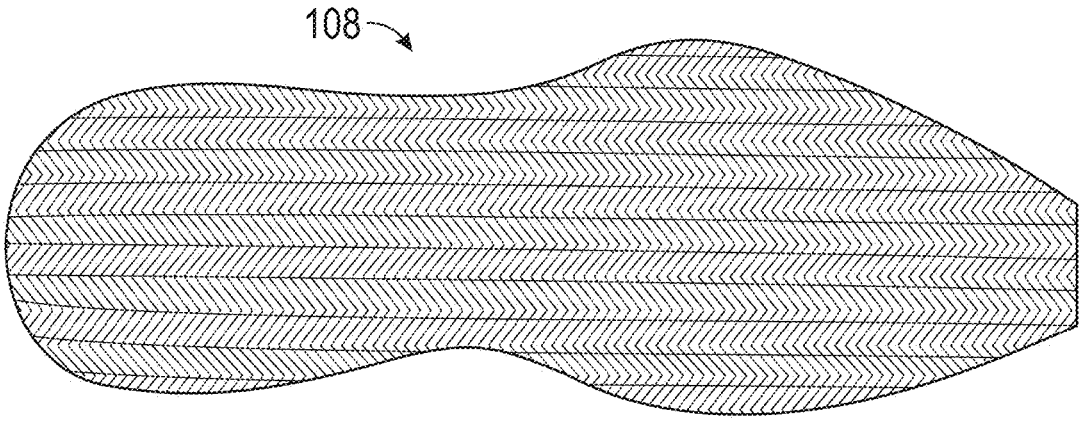
FIG. 45 depicts an inferior view of the outsole of the sole structure of FIG. 1.
Figure 46:
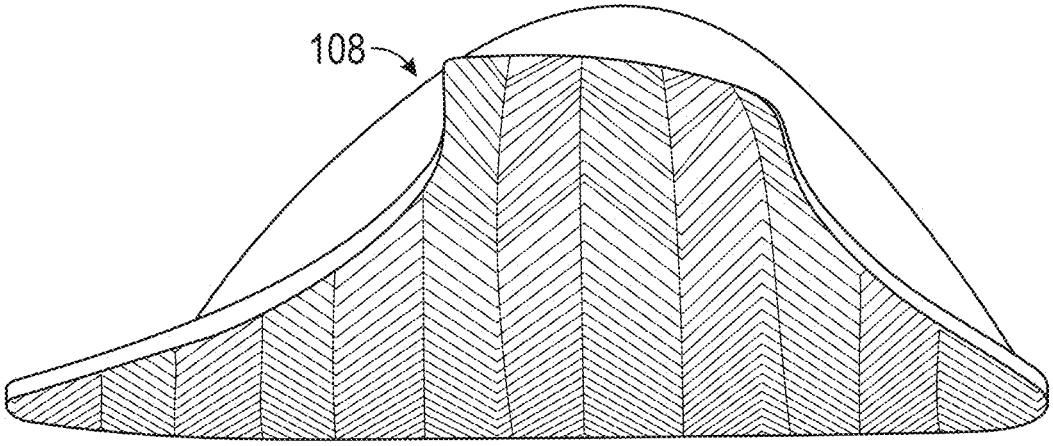
FIG. 46 depicts an anterior end view of the outsole of the sole structure of FIG. 1.
Figure 47:
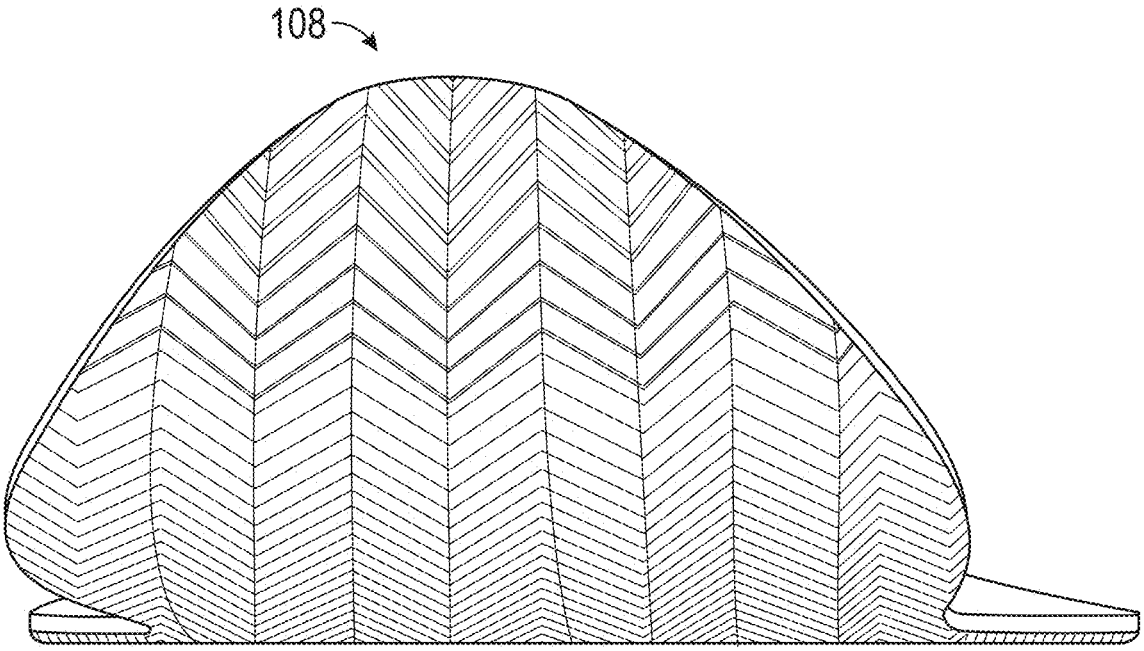
FIG. 47 depicts a posterior end view of the outsole of the sole structure of FIG. 1.

FIGS. 41-47 depict the outsole 108 of the sole structure 100. The outsole 108 is configured to contact the ground surface. Accordingly, the outsole 108 can, for example, be configured to provide increased traction and/or to protect the other components of the sole structure 100 and/or an upper. In some examples, the outsole can comprise various traction elements (e.g., nubs, ribs, cleats, lugs, patterns, etc.) configured for engaging one or more types of ground surfaces. For example, as depicted in FIG. 45, the outsole 108 comprises a plurality of ribs arranged in various orientations. This outsole configuration can be used, for example, on relatively hard and smooth surfaces such as a basketball court (e.g., hardwood, concrete, asphalt, etc.). For different applications (e.g., soft surfaces), the outsole can comprise cleats or lugs configured to engage and/or penetrate the ground surface (e.g., dirt or grass). In some examples, the outsole 108 can comprise one or more relatively flexible polymeric materials (e.g., thin rubber). In some examples, the outsole 108 can comprise one or more relatively rigid polymeric materials (e.g., TPU) and/or other materials (e.g., metals, composites, etc.).

FIG. 48 depicts an article of footwear 200 comprising the sole structure 100 and an upper 202, according to one example. The sole structure 100 and/or its components can be adapted for use with various other article of footwear and/or uppers.

In some examples, the upper comprises a throat portion separating the lateral side of the upper and the medial side of the upper. The upper also comprises a tongue disposed at least partially within the throat portion. In some examples, the upper can be formed without a throat portion and/or a tongue.

The upper of the footwear can be formed of various materials. For example, the upper can be formed of one or more of the following materials: textiles, foam, leather, polymers, and/or synthetic leather. In some examples, the upper can be formed as a single, unitary component (e.g., by knitting or molding). In some examples, the upper can comprise a plurality of components that are coupled together (e.g., by stitching, adhesive, fasteners, etc.).

The upper 202 can be fixedly coupled to the sole structure 100 in various ways. The upper 202 can be attached (e.g., stitched) to a strobel, and the strobel can be attached to the first midsole member 102*a* (e.g., with an adhesive). In other examples, the strobel can be omitted, and the upper 202 can be attached to a component of the sole structure 100. In some such examples, the upper 202 can be directly attached to the first midsole member 102*a* via adhesive, stitching, and/or other means for coupling.

The article of footwear 200 can, in some instances, further comprise a sockliner (which may also be referred to as "an insole"). The sockliner can be configured to be positioned directly underfoot and is configured to cushion and/or support the wearer's foot. The sockliner can comprise various materials including textile, leather, foam, and/or other types of materials.

Figure 49:
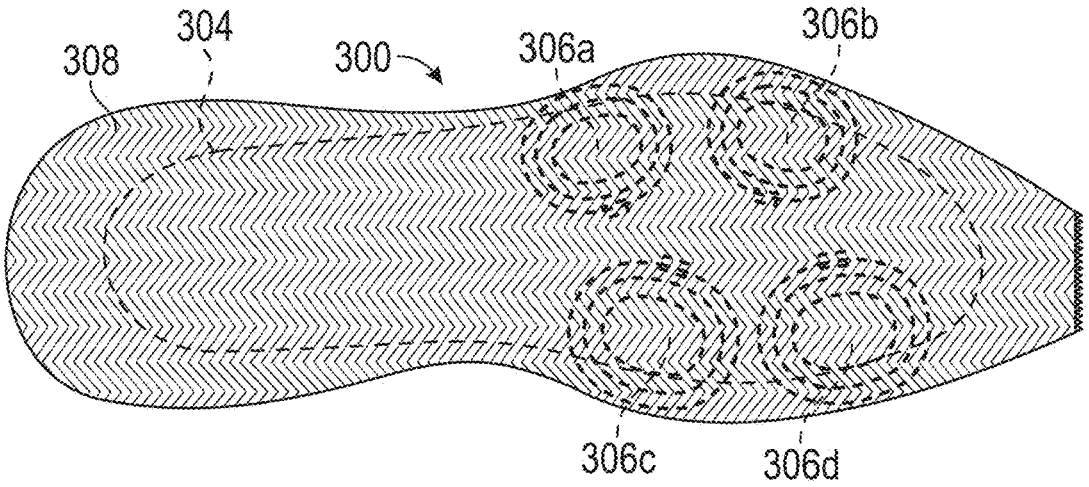
FIG. 49 depicts an inferior view of another example of a sole structure comprising an alternative cushioning element configuration.
Figure 50:
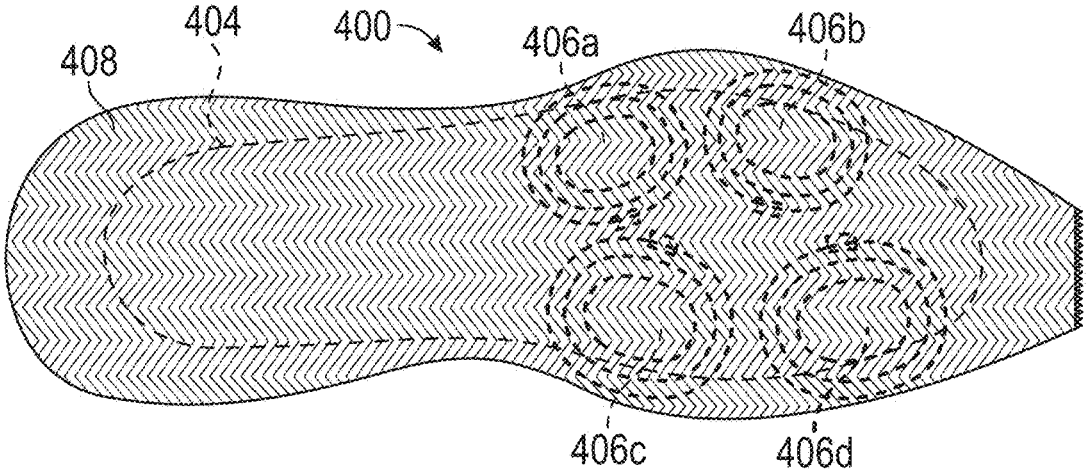
FIG. 50 depicts an inferior view of another example of a sole structure comprising an alternative cushioning element configuration.
Figure 51:
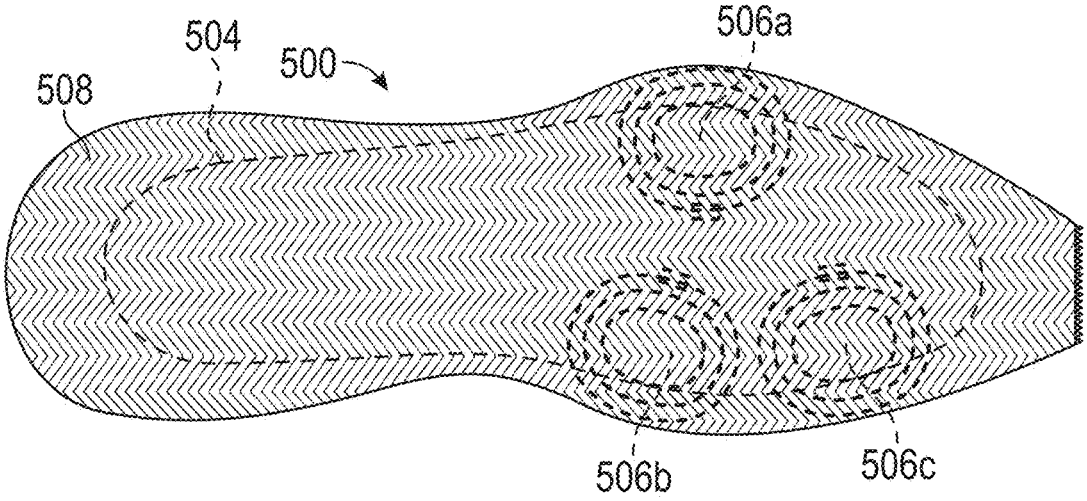
FIG. 51 depicts an inferior view of another example of a sole structure comprising an alternative cushioning element configuration.

FIG. 49-51 depicts another exemplary sole structures 300, 400, and 500, respectively. The sole structures 300, 400, 500 are similar to the sole structure 100. As such, similar components are labeled similarly. For example, the spring plates 304, 404, 504 are similar to the spring plate 104, and the outsoles 308, 408, and 508 are similar to the outsole 108. One difference between the sole structures 300, 400, and 500 and the sole structure 100 is the configuration of the cushioning elements (e.g., airbags). For example, the sole structure 100 comprises two cushioning elements (i.e., a first cushioning element 106*a* and a second cushioning element 106*b*) that are stacked upon one another. The sole structures 300, 400, and 500 comprise more than two cushioning elements (e.g., 3-4), the cushioning elements are not stacked upon one another, and the cushioning elements are relatively smaller. Another difference is that the cushioning elements extend outwardly beyond the peripheral edge of the spring plate. Configuring the cushioning elements as depicted in FIGS. 49-51 can, for example, improve lateral stability of the sole structure.

The sole structure 300 comprises four cushioning elements 306*a*, 306*b*, 306*c*, and 306*d*. The cushioning elements 306*a* and 306*b* are disposed on the lateral side of the sole structure 300, and the cushioning elements 306*c* and 306*d* are disposed on the lateral side of the sole structure 300. The cushioning elements 306*a* and 306*b* are smaller than the cushioning elements 306*c* and 306*d*. The cushioning elements 306*a* and 306*b* are the same size, and the cushioning elements 306*c* and 306*d* are the same size.

The sole structure 400 also comprises four cushioning elements 406*a*, 406*b*, 406*c*, and 406*d*. The cushioning elements 406*a* and 406*b* are disposed on the lateral side of the sole structure 400, and the cushioning elements 406*c* and 406*d* are disposed on the lateral side of the sole structure 400. Compared to the cushioning elements 306 of the sole structure 300, the cushioning elements 406 of the sole structure are relatively larger. More specifically, the cushioning elements 406*a* and 406*b* are larger than the cushioning elements 306*a* and 306*b* and smaller than the cushioning elements 306*c* and 306*d*. The cushioning elements 406*c* and 406*d* are larger than the cushioning elements 406*a* and 406*b*, as well as the cushioning elements 306*c* and 306*d*.

The sole structure 500 comprises three cushioning elements 506*a*, 506*b*, and 506*c*. The cushioning element 506*a* is disposed on the lateral side of the sole structure 500, and the cushioning elements 506*b* and 506*c* are disposed on the medial side of the sole structure 500. The cushioning element 506*a* is the same size as the cushioning elements 306*a* and 306*b*, and the cushioning elements 506*b* and 506*c* are the same or at least substantially the same size as the cushioning elements 306*c* and 306*d*.

The disclosed sizes and configurations of the cushioning elements disclosed herein are merely examples. Various other sizes and configurations of cushioning elements within the scope of this disclosure. For example, a sole structure can have any number of cushioning elements (e.g., 1-10) and/or can be formed without any cushioning elements. Additionally (or alternatively), the relative size and/or location of the cushioning elements can be altered (e.g., to achieve a desired performance characteristic, such as compression, rebound, lateral stability, etc.).

It should also be noted that, although the articles of footwear depicted and/or described herein are primarily configured as basketball shoes or basketball-related shoes (e.g., dunking shoes), the disclosed articles of footwear, sole structures, and/or components thereof are suitable and/or can readily be adapted for use in various other sports, particularly those involving jumping. For example, the sole structures disclosed herein can be used with track and field shoes (e.g., running, high jump, long jump, etc.).

Further aspects of the disclosure are provided by the subject matter of the following examples:

1. A sole structure for an article of footwear, comprising an outsole, a spring plate, a first midsole member, one or more cushioning elements, and a second midsole member. The spring plate comprises an inferior segment and a superior segment. The inferior segment and the superior segment each comprise an anterior portion and a posterior portion. The inferior segment and the superior segment are piviotably coupled together at their anterior portions. The inferior segment and the superior segment are spaced apart from each other in the anterior/superior direction at their posterior portions. The first midsole member is disposed between the inferior segment of the spring plate and the superior segment of the spring plate. The one or more cushioning elements are disposed between the first midsole portion and the superior segment of the spring plate. The second midsole member is disposed on superior segment of the spring plate.

2. The sole structure of any example herein, and particularly example 1, wherein the one or more cushioning elements comprises a first cushioning element and a second cushioning element, the first cushioning element is disposed on the first midsole member, and the second cushioning element is disposed between the first cushioning member and the superior segment of the spring plate.

3. The sole structure of any example herein, and particularly either example 1 or example 2, wherein the one or more cushioning elements comprising at least one fluid-filled chamber.

4. The sole structure of any example herein, and particularly any one of examples 1-3, wherein the one or more cushioning elements includes a first cushioning element and a second cushioning element, the first cushioning element has a first volume, the second cushioning element has a second volume, and the second volume is different than the first volume.

5. The sole structure of any example herein, and particularly any one of examples 1-4, wherein the one or more cushioning elements includes a first cushioning element and a second cushioning element, the first cushioning element has a first pressure, the second cushioning element has a second pressure, and the second pressure is different than the first pressure.

6. The sole structure of any example herein, and particularly any one of examples 1-3, wherein the one or more cushioning elements includes a plurality of cushioning elements stacked directly on one another.

7. The sole structure of any example herein, and particularly any one of examples 1-6, wherein the one or more cushioning elements is exactly two cushioning elements.

8. The sole structure of any example herein, and particularly any one of examples 1-3, wherein the one or more cushioning elements is exactly three cushioning elements.

9. The sole structure of any example herein, and particularly any one of examples 1-3, wherein the one or more cushioning elements is exactly four cushioning elements.

10. The sole structure of any example herein, and particularly any one of examples 1-3, wherein the one or more cushioning elements is exactly six cushioning elements.

11. The sole structure of any example herein, and particularly any one of examples 1-3, wherein the one or more cushioning elements is exactly eight cushioning elements.

12. The sole structure of any example herein, and particularly any one of examples 1-3, wherein the one or more cushioning elements is 2-4 cushioning elements.

13. The sole structure of any example herein, and particularly any one of examples 1-3, wherein the one or more cushioning elements is 2-6 cushioning elements.

14. The sole structure of any example herein, and particularly any one of examples 1-3, wherein the one or more cushioning elements is 2-8 cushioning elements.

15. The sole structure of any example herein, and particularly any one of examples 1-3, wherein the one or more cushioning elements is 3-4 cushioning elements.

16. The sole structure of any example herein, and particularly any one of examples 1-3, wherein the one or more cushioning elements is 3-6 cushioning elements.

17. The sole structure of any example herein, and particularly any one of examples 1-3, wherein the one or more cushioning elements is 3-8 cushioning elements.

18. The sole structure of any example herein, and particularly any one of examples 1-3, wherein the one or more cushioning elements is 4-6 cushioning elements.

19. The sole structure of any example herein, and particularly any one of examples 1-3, wherein the one or more cushioning elements is 4-8 cushioning elements.

20. The sole structure of any example herein, and particularly any one of examples 1-3, wherein the one or more cushioning elements is 6-8 cushioning elements.

21. The sole structure of any example herein, and particularly any one of examples 1-6, wherein the posterior portion of the superior segment of the spring plate extends farther in the posterior direction than the posterior portion of the inferior segment of the spring plate.

22. The sole structure of any example herein, and particularly any one of examples 1-21, wherein the posterior portion of the inferior segment of the spring plate curves upward in the superior direction.

23. The sole structure of any example herein, and particularly any one of examples 1-22, wherein the posterior portion of the superior segment of the spring plate curves upward in the superior direction.

24. The sole structure of any example herein, and particularly any one of examples 1-23, wherein the spring plate comprises carbon fiber.

25. The sole structure of any example herein, and particularly any one of examples 1-24, wherein the spring plate comprise steel.

26. The sole structure of any example herein, and particularly any one of examples 1-25, wherein the spring plate comprises titanium.

27. The sole structure of any example herein, and particularly any one of examples 1-26, wherein the spring plate comprise nitinol.

28. The sole structure of any example herein, and particularly any one of examples 1-27, wherein the spring plate is biased to an uncompressed state with a first spacing between the inferior segment and the superior segment, the spring plate is elastically deformable from the uncompress state to a compressed state with a second spacing between the inferior segment and the superior segment, and the second spacing is less than the first spacing.

29. The sole structure of any example herein, and particularly any one of examples 1-28, wherein the first midsole member comprises a forefoot portion and a heel portion, and the heel portion of the first midsole member is thicker than the forefoot portion of the first midsole member.

30. The sole structure of any example herein, and particularly any one of examples 1-29, wherein the second midsole member comprises a forefoot portion and a heel portion, and the heel portion of the second midsole member is thicker than the forefoot portion of the second midsole member.

31. A sole structure for an article of footwear, comprising a spring plate. The spring plate comprises an inferior segment and a superior segment. The inferior segment and the superior segment each comprise an anterior portion and a posterior portion. The inferior segment and the superior segment are piviotably coupled together at their anterior portions. The inferior segment and the superior segment are spaced apart from each other in the anterior/superior direction at their posterior portions.

32. The sole structure of any example herein, and particularly examples 31, further comprising an outsole coupled to the inferior segment of the spring plate.

33. The sole structure of any example herein, and particularly either example 31 or example 32, further comprising a first midsole member disposed between the inferior segment of the spring plate and the superior segment of the spring plate.

34. The sole structure of any example herein, and particularly any one of examples 31-33, a second midsole member disposed on superior segment of the spring plate.

35. An article of footwear comprising the sole structure of any example herein, and particularly any one of examples 1-34. The article of footwear further comprises an upper coupled to the second midsole member. The upper comprises a cavity configured to receive a wearer's foot.

Any feature(s) of any example(s) disclosed herein can be combined with or isolated from any feature(s) of any example(s) disclosed herein, unless otherwise stated. For example, an article of footwear may comprise one or more components of one or more of the sole structures disclosed herein (e.g., the sole structure 100, 300, 400, and/or 500) in combination with an upper (e.g., the upper 202).

In view of the many possible examples to which the principles of the disclosure may be applied, it should be recognized that the illustrated examples should not be taken as limiting the scope of the claims. Rather, the scope of the claimed subject matter is defined by the following claims and their equivalents.

The invention claimed is:

1. A sole structure for an article of footwear, comprising:

an outsole;

a spring plate comprising an inferior segment and a superior segment integrally formed as a single, unitary component, wherein the inferior segment and the superior segment each comprise an anterior portion and a posterior portion, wherein the posterior portion of the superior segment extends farther in a posterior direction than the posterior portion of the inferior segment, wherein the inferior segment and the superior segment are piviotably coupled together at their anterior portions, and wherein the inferior segment and the superior segment are spaced apart from each other in an anterior/superior direction at their posterior portions;

a first midsole member disposed on the superior segment of the spring plate;

a second midsole member comprising a forefoot portion and a heel portion, wherein the forefoot portion of the second midsole member is disposed between the outsole and the inferior segment of the spring plate, and wherein the heel portion of the second midsole member extends in the posterior direction beyond the inferior segment of the spring plate and is disposed between the outsole and the superior segment of the spring plate; and one or more cushioning elements disposed between the inferior segment and the superior segment of the spring plate.

2. The sole structure of claim 1, wherein the one or more cushioning elements comprises a first cushioning element and a second cushioning element, wherein the first cushioning element is disposed on the second midsole member, and wherein the second cushioning element is disposed between the first cushioning member and the superior segment of the spring plate.

3. The sole structure of claim 1, wherein the one or more cushioning elements comprising at least one fluid-filled chamber.

4. The sole structure of claim 1, wherein the one or more cushioning elements includes a plurality of cushioning elements stacked directly on one another.

5. The sole structure of claim 1, wherein the one or more cushioning elements is exactly two cushioning elements.

6. The sole structure of claim 1, wherein the one or more cushioning elements is exactly three cushioning elements.

7. The sole structure of claim 1, wherein the one or more cushioning elements is exactly four cushioning elements.

8. The sole structure of claim 1, wherein the posterior portion of the inferior segment of the spring plate curves upward in the superior direction.

9. The sole structure of claim 1, wherein the posterior portion of the superior segment of the spring plate curves upward in the superior direction.

10. The sole structure of claim 1, wherein the spring plate is biased to an uncompressed state with a first spacing between the inferior segment and the superior segment, wherein the spring plate is elastically deformable from the uncompress state to a compressed state with a second spacing between the inferior segment and the superior segment, and wherein the second spacing is less than the first spacing.

11. The sole structure of claim 1, wherein the first midsole member comprises a forefoot portion and a heel portion, and wherein the heel portion of the first midsole member is thicker than the forefoot portion of the first midsole member.

12. The sole structure of claim 1, wherein the heel portion of the second midsole member is thicker than the forefoot portion of the second midsole member.

13. A sole structure for an article of footwear, comprising:

a spring plate comprising an inferior segment and a superior segment, wherein the inferior segment and the superior segment each comprise an anterior portion and a posterior portion, wherein the inferior segment and the superior segment are integrally formed as a single, unitary component and are piviotably coupled together at their anterior portions, a midsole member, and an outsole coupled to the inferior segment of the spring plate, wherein the inferior segment and the superior segment are spaced apart from each other in an anterior/superior direction at their posterior portions, and wherein the midsole member comprises a forefoot portion and a heel portion, wherein the forefoot portion of the midsole member is disposed between the outsole and the inferior segment of the spring plates and wherein the heel portion of the midsole member is disposed between the outsole and the superior segment of the spring plate.

14. The sole structure of claim 13, wherein the midsole member is a second midsole member, and the sole structure further comprises a first midsole member disposed on superior segment of the spring plate and separated from the second midsole member by the spring plate.

15. An article of footwear comprising:

the sole structure of claim 14; and an upper coupled to the first midsole member, wherein the upper comprises a cavity configured to receive a wearer's foot.

* * * * *